US010279213B2

(12) United States Patent
Agostini

(10) Patent No.: US 10,279,213 B2
(45) **Date of Patent: *May 7, 2019**

(54) EXERCISE DEVICE

(71) Applicant: Scott C. Agostini, San Juan Capistrano, CA (US)

(72) Inventor: Scott C. Agostini, San Juan Capistrano, CA (US)

( * ) Notice: Subject to any disclaimer, the term of this patent is extended or adjusted under 35 U.S.C. 154(b) by 1 day.

This patent is subject to a terminal disclaimer.

(21) Appl. No.: 15/833,785

(22) Filed: Dec. 6, 2017

(65) Prior Publication Data

US 2018/0093129 A1 Apr. 5, 2018

Related U.S. Application Data

(63) Continuation of application No. 15/366,945, filed on Dec. 1, 2016, now Pat. No. 9,878,199, which is a continuation of application No. 14/976,128, filed on Dec. 21, 2015, now Pat. No. 9,539,465, which is a continuation of application No. 14/739,211, filed on Jun. 15, 2015, now Pat. No. 9,216,321, which is a continuation of application No. 13/421,317, filed on Mar. 15, 2012, now Pat. No. 9,079,072.

(60) Provisional application No. 61/478,358, filed on Apr. 22, 2011, provisional application No. 61/469,989, filed on Mar. 31, 2011.

(51) Int. Cl.

| | |
|---|---|
| ***A63B 21/00*** | (2006.01) |
| ***A63B 22/18*** | (2006.01) |
| ***A63B 22/20*** | (2006.01) |
| ***A63B 23/12*** | (2006.01) |
| ***A63B 26/00*** | (2006.01) |
| ***A63B 21/012*** | (2006.01) |

(52) U.S. Cl.

CPC ..... *A63B 21/4043* (2015.10); *A63B 21/0004* (2013.01); *A63B 21/012* (2013.01); *A63B 21/4035* (2015.10); *A63B 22/18* (2013.01); *A63B 22/203* (2013.01); *A63B 23/1236* (2013.01); *A63B 26/003* (2013.01); *A63B 2022/206* (2013.01)

(58) Field of Classification Search

None

See application file for complete search history.

(56) References Cited

U.S. PATENT DOCUMENTS

| | | | |
|---|---|---|---|
| 1,824,920 | A | 9/1931 | Novak |
| 3,306,626 | A | 2/1967 | Kawada |
| 3,379,454 | A | 4/1968 | Woodman |
| 3,604,726 | A | 9/1971 | Tracy |
| 3,622,152 | A | 11/1971 | Place |

(Continued)

OTHER PUBLICATIONS aileensheron.com; OmniBall; website http://aileensheron.com/omniball/; Nov. 2, 2015; 3 pages.

(Continued)

*Primary Examiner* — Stephen R Crow

(74) *Attorney, Agent, or Firm* — Stetina Brunda Garred and Brucker

(57) ABSTRACT

Provided is an exercise device including a planar support surface and a rolling joint which is configured to enable a 360° range of motion for the exercise device. In this regard, the user may roll the exercise device along a planar surface in a forward-and-backward motion, a side-to-side motion, or in an arcuate or circular motion.

20 Claims, 23 Drawing Sheets

(56) References Cited

U.S. PATENT DOCUMENTS

| | | | |
|---|---|---|---|
| 3,716,229 | A | 2/1973 | Der Cleyen |
| 3,806,116 | A | 4/1974 | Malmberg et al. |
| 3,862,768 | A | 1/1975 | England |
| 3,895,794 | A | 7/1975 | England |
| 3,995,873 | A | 12/1976 | Pantzar |
| 4,116,233 | A | 9/1978 | Scaduto |
| 4,191,371 | A | 3/1980 | Armer, Jr. |
| 4,509,743 | A | 4/1985 | Lie |
| 4,759,542 | A | 7/1988 | Hudec |
| 600,172 | A | 3/1989 | Johnson |
| 4,826,159 | A | 5/1989 | Hersey |
| 5,092,586 | A | 3/1992 | Tuthill et al. |
| 5,509,871 | A | 4/1996 | Giovanni |
| 5,632,707 | A | 5/1997 | Daniel et al. |
| 5,735,776 | A | 4/1998 | Swezey |
| 5,897,474 | A | 4/1999 | Romero |
| D428,454 | S | 7/2000 | Fischer |
| 6,652,421 | B1 | 11/2003 | Chen |
| 6,773,379 | B1 | 8/2004 | Bing |
| 6,945,920 | B1 | 9/2005 | Kemery et al. |
| D552,696 | S | 10/2007 | Hallar |
| 7,300,392 | B1 | 11/2007 | Curran |
| D564,604 | S | 3/2008 | Mikail |
| 7,357,767 | B2 | 4/2008 | Tsai |
| 7,500,324 | B1 | 3/2009 | Power et al. |
| 7,621,858 | B2 | 11/2009 | Sheron |
| 7,632,218 | B2 | 12/2009 | Sannes et al. |
| 7,678,027 | B2 | 3/2010 | Sanghavi |
| 7,775,952 | B1 | 8/2010 | Curran |
| D627,015 | S | 11/2010 | Senegal |
| 7,883,452 | B1 | 2/2011 | Chen |
| 7,942,796 | B2 | 5/2011 | Signorile |
| 7,981,016 | B1 | 7/2011 | Howard |
| 8,353,808 | B1 | 1/2013 | Barney |
| 8,550,965 | B2 | 10/2013 | Candela |
| 8,702,574 | B2 | 4/2014 | Abranchess |
| 8,827,879 | B2 | 9/2014 | Nicholas |
| 9,079,072 | B2 * | 7/2015 | Agostini ..... A63B 22/18 |
| 9,199,117 | B1 | 12/2015 | Nicholas |
| 9,216,321 | B2 | 12/2015 | Agostini |
| D749,178 | S | 2/2016 | Nicholas |
| 9,327,155 | B2 | 5/2016 | Doyle |
| 9,539,465 | B2 * | 1/2017 | Agostini ..... A63B 22/18 |
| 9,878,199 | B2 * | 1/2018 | Agostini ..... A63B 21/4043 |
| 2004/0009859 | A1 | 1/2004 | Gottlieb |
| 2004/0018924 | A1 | 1/2004 | Szydlowski et al. |
| 2005/0209072 | A1 | 9/2005 | Sheron |
| 2006/0211553 | A1 | 9/2006 | Cantor |
| 2007/0254789 | A1 | 11/2007 | Odien |
| 2007/0298947 | A1 | 12/2007 | Eksteen |
| 2009/0325770 | A1 | 12/2009 | Baschnagel |
| 2010/0087301 | A1 | 8/2010 | Juncker |
| 2010/0261590 | A1 | 10/2010 | Fares |
| 2010/0331154 | A1 | 12/2010 | Taylor |
| 2011/0160024 | A1 | 6/2011 | Candela |
| 2011/0251033 | A1 | 10/2011 | Blancher |
| 2012/0252645 | A1 | 10/2012 | Agostini |
| 2012/0264579 | A1 | 10/2012 | Klein et al. |
| 2013/0237395 | A1 | 9/2013 | Hjelt et al. |

OTHER PUBLICATIONS

FEWDM; OmniBall; website https://fewdm.com/shop/omniball/; Nov. 2, 2015; 4 pages.

International Search Report, dated Sep. 21, 2012, 2 pages.

http://www.fitforallball.com/, 2012, 2 pages.

* cited by examiner

Bottom Isometric View

Exploded Isometric View

Exploded Section View

Detail B

Top Isometric View

Section view

Detail A

Section view

Section view

Section view 240
250
242
242
242

EXERCISE DEVICE

CROSS-REFERENCE TO RELATED APPLICATIONS

This application is a continuation of U.S. patent application Ser. No. 15/366,945, filed on Dec. 1, 2016, which is a continuation of U.S. patent application Ser. No. 14/976,128, filed on Dec. 21, 2015, now U.S. Pat. No. 9,539,465, issued on Jan. 10, 2017, which is a continuation of U.S. patent application Ser. No. 14/739,211, filed on Jun. 15, 2015, now U.S. Pat. No. 9,216,321, issued on Dec. 22, 2015, which is a continuation of U.S. patent application Ser. No. 13/421,317, filed on Mar. 15, 2012, now U.S. Pat. No. 9,079,072, issued on Jul. 14, 2015, which claims the benefit of U.S. Provisional Application No. 61/469,989, filed Mar. 31, 2011 and U.S. Provisional Application No. 61/478,358, filed Apr. 22, 2011, the entire contents of which are incorporated herein by reference.

STATEMENT RE: FEDERALLY SPONSORED RESEARCH/DEVELOPMENT

Not Applicable

BACKGROUND OF THE INVENTION

Technical Field

The present invention relates generally to exercise devices, and more specifically, to an exercise device including a ball and socket arrangement mounted to a support surface to achieve 360° freedom of movement.

Description of the Related Art

It is well-known that routine exercise is good for both the body and mind. Along these lines, each community typically includes a gym or fitness center where individuals can access a wide variety of exercise equipment. Although such gyms and fitness centers may facilitate routine exercise for certain individuals, there are various drawbacks associated with gyms and fitness centers. One drawback is that the gyms/fitness centers generally require membership for access into their facilities. The membership agreements may require a long-term commitment from the individual, which may add up to a significant expense for the individual. Another drawback is that it may be difficult for some individuals to make time in their day-to-day schedules to go to the gyms/fitness centers.

Therefore, various home-fitness machines have been developed to allow individuals to exercise within the comfort of their own home. Certain home-fitness machines are "universal" in nature, and allow an individual to exercise multiple muscle groups. However, such "universal" machines tend to be very large and very expensive. Other home-fitness machines are smaller and tend to focus on one particular muscle or muscle group.

Many of the smaller fitness devices tend to be of the "roller" variety, wherein a user rolls the device forward and backward along a planar surface to conduct the exercise. The device may include a wheel and handles for the user to grasp. The user may kneel on his knees and extend his torso away from his knees, and then back toward his knees, with the roller rolling forward and backward to facilitate such motion. The foregoing exercise may workout the user's core, especially the abdominal muscles and back muscles.

Although the smaller fitness devices may provide a suitable alternative to full-fledged gym memberships discussed above, there are certain features that are common to conventional roller-type exercise devices which detract from their overall utility. One drawback is that the devices are generally limited to a rolling motion along a single axis. In other words, the devices roll forward and backward along a common axis, and are not capable of rolling from side-to-side. Such side-to-side motion would be desirable to allow for a more circular exercise motion to work out more muscle groups.

Therefore, in view of the foregoing, there is a need in the art for a personal exercise device that offers a broader range of motion compared to traditional roller-type exercise devices. The present invention addresses this particular need, as explained in the following sections and as shown in the accompanying drawings.

BRIEF SUMMARY OF THE INVENTION

The present invention specifically addresses and alleviates the above-identified deficiencies in the art. In this regard, the present invention is directed to an exercise device including a planar support surface and a rolling joint which is configured to enable a 360° range of motion for the exercise device. In this regard, the user may roll the exercise device along a planar surface in a forward-and-backward motion, a side-to-side motion, or in an arcuate or circular motion.

According to one implementation, the exercise device includes a planar support surface including a first face, an opposing second face, and a sidewall extending between the first face and the second face. The support surface may include one or more handles to allow a user to easily grab onto the device. A rolling joint is coupled to the second face and is configured to allow the exercise device to move about a planar surface, such as a floor or wall. The rolling joint includes a joint wall extending from the second face of the support surface to define a cavity configured to receive a rolling ball which facilitates such motion of the exercise device. The rolling ball is preferably a single ball (i.e., uniball).

It is contemplated that the rolling joint may be configured to lock the rolling ball to restrict rotation of the rolling ball. For instance, the rolling ball may be restricted to rotation about a single axis. In this regard, the exercise device may be configurable between a free range of motion device, to a more restricted range of motion device, as may be desired to target certain muscle groups or areas. The rolling joint may additionally be configured to restrict rotation of the rolling ball in all directions to allow the exercise device to be used as a pivot board.

The present invention is best understood by reference to the following detailed description when read in conjunction with the accompanying drawings.

BRIEF DESCRIPTION OF THE DRAWINGS

These, as well as other features of the present invention will become more apparent upon reference to the drawings wherein.

Common reference numerals are used throughout the drawings and detailed description to indicate like elements.

DETAILED DESCRIPTION OF THE INVENTION

Figure 1:
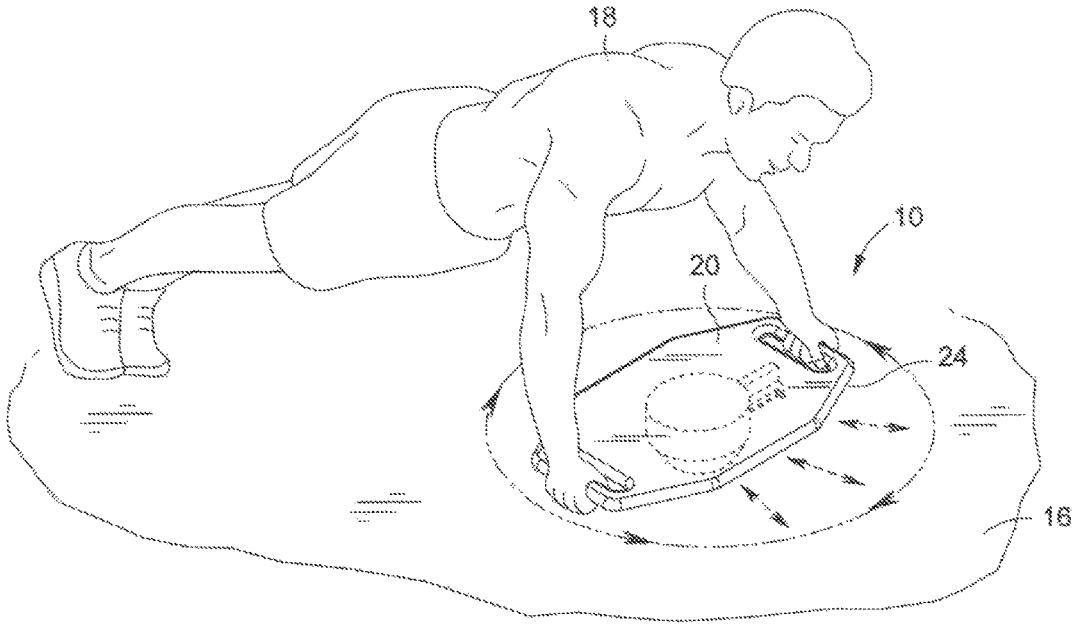
FIG. 1 is an upper perspective view of an embodiment of an exercise device and a user performing an exercise using the device.
Figure 2:
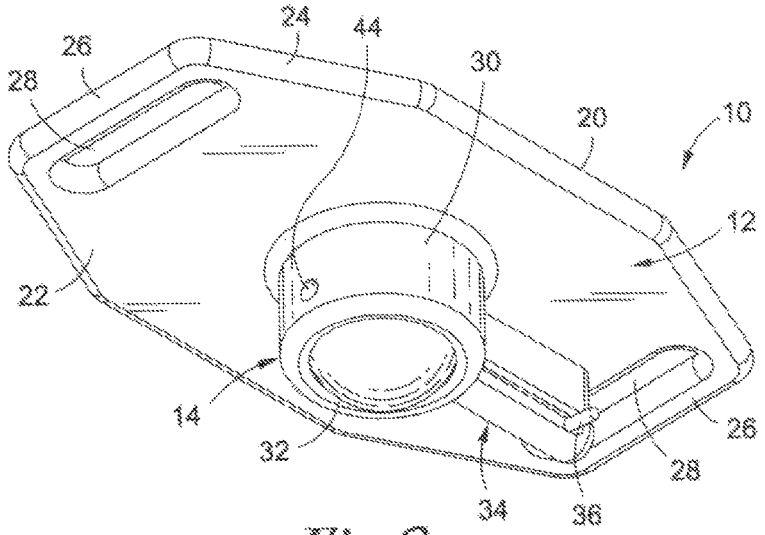
FIG. 2 is a lower perspective view of the exercise device.
Figure 3:
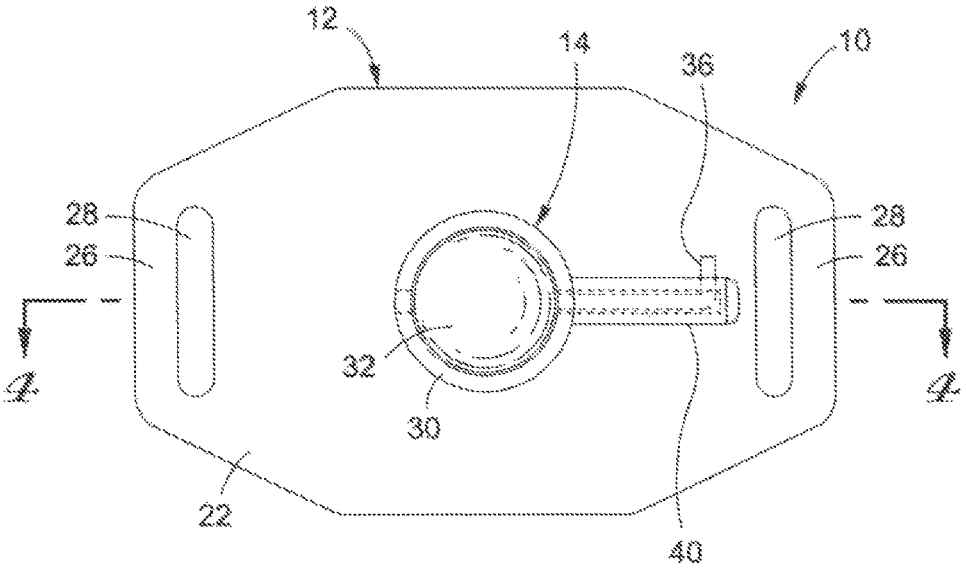
FIG. 3 is a bottom view of the exercise device.
Figure 4:
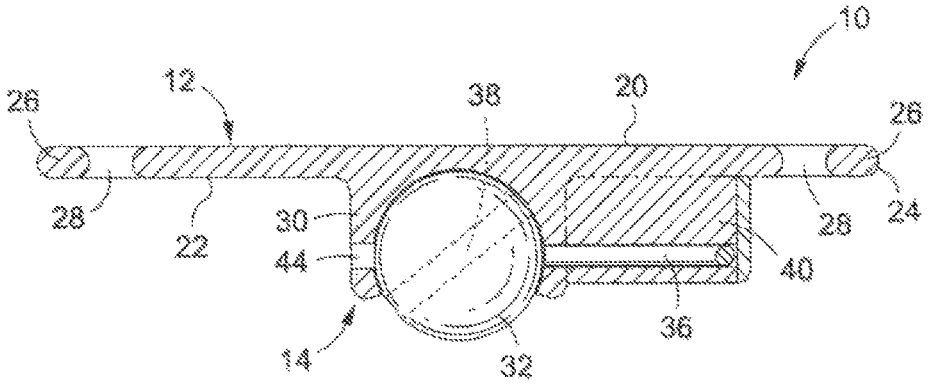
FIG. 4 is a side sectional view of the exercise device in an unlocked configuration.
Figure 5:
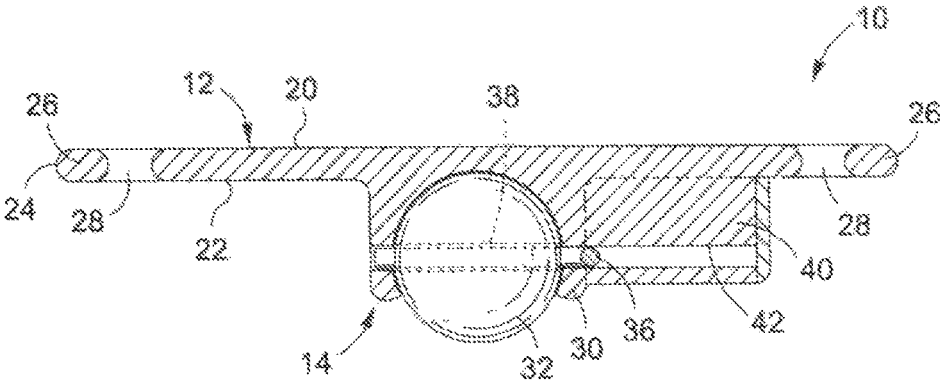
FIG. 5 is a side sectional view of the exercise device in a locked configuration.

The detailed description set forth below is intended as a description of the presently preferred embodiment of the invention, and is not intended to represent the only form in which the present invention may be constructed or utilized. The description sets forth the structure of various embodiments of the invention, as well as functions and sequences of steps for constructing and operating certain embodiments of the invention. It is to be understood, however, that the same or equivalent functions and sequences may be accomplished by different embodiments and that they are also intended to be encompassed within the scope of the invention.

Referring now to FIGS. 1-5, there is shown a first embodiment of an exercise device 10 comprised of a support plate 12 and a rolling joint 14 attached to the support plate 12. When the exercise device 10 is placed against a planer surface 16, such as the floor or a wall, the exercise device 10 may be moved about the surface 16 in a circular manner or an axial manner. A user 18 may grip the support plate 12 at opposed locations thereof and selectively roll the device 10 outward, backward, and sideward to workout various muscle groups, including the abs and back. The rolling joint 14 advantageously allows the device 10 to achieve a 360° freedom of movement to broaden the range of exercise motion achievable by the device 10. In this regard, the device 10 is not merely limited to movement along a single axis, rather, the device 10 may be selectively moved by the user 18 along several different axes, as well as in a curved motion.

The support plate 12 defines a first face 20, an opposing second face 22, and a side wall 24 extending between the first face 20 and the second face 22 and defining a thickness between the first face 20 and the second face 22. The support plate 12 additionally includes a pair of handles 26 defined by a pair of openings 28 formed within the support plate 12, wherein each opening 28 extends through the thickness of a support plate 12 from the first face 20 to the second face 22.

The support plate 12 depicted in FIGS. 1-5 includes substantially planer first and second faces 20, 22 and defines eight peripheral edges. However, those skilled in the art will appreciate that the support plate 12 may define other shapes, sizes, and configurations without departing from the spirit and scope of the present invention.

The support plate 12 may be formed from wood, a plastic material, a metallic material, or other materials known by those skilled in the art.

The rolling joint 14 is attached to the second face 22 of the support plate 12. In the embodiment depicted in FIGS. 1-5, the rolling joint 14 includes a joint wall 30 and a rolling ball 32 disposed within the joint wall 30. The joint wall 30 and rolling ball 32 may be configured to reduce the amount of friction created between the rolling ball 32 and the joint wall 30 as the rolling ball 32 moves relative to the joint wall 30. The rolling ball 32 may be secured within the joint wall 30 such that the rolling ball 32 may have a 360° freedom of movement relative to the joint wall 30.

It is contemplated that the joint wall 30 may be integrally formed with the support plate 12. Along these lines, the joint wall 30 and support plate 12 may be molded from a single piece of plastic or metallic, or other moldable material. Alternatively, the joint wall 30 may be separate from the support plate 12, and may be secured thereto by a mechanical fastener, such as nails, nuts and bolts, adhesives, or other mechanical fasteners known in the art. The rolling ball 32 may be formed of a material that corroborates with the material used to form the joint wall 30. For instance, the rolling ball 32 may be formed from metal, plastics, or other materials known in the art.

According to one embodiment, the exercise device 10 includes a locking mechanism 34 to restrict rotation of the rolling ball 32, such as rotation about one axis, or a restriction of rotation in all directions. In the particular implementation shown in FIGS. 1-5, the locking mechanism 34 includes a pin 36 that extends through an aperture 38 formed within the rolling ball 32. The pin 36 is transitional between an unlocked position, wherein the rolling ball 32 is free to rotate about any axis, and a locked configuration (see FIG. 5), wherein the pin 36 is advanced through the aperture 38 formed within the ball 32 to restrict rotation of the ball 32.

In one embodiment, the pin 36 restricts rotation about a single axis (i.e., about the pin 36) when the pin 36 is in the locked configuration. In another embodiment, the pin 36 may completely restrict rotation of the ball 32 in all directions when the pin is in the locked configuration. For instance, the pin 36 may be sized to create substantial frictional forces between the pin 36 and the ball 32 to effectively restrict rotation of the ball 32. The pin 36 may be secured within a pin housing 40 connected to the joint wall 30. The pin housing 40 may include a slot 42 sized to accommodate the pin 36 and to allow for transition of the pin 36 between the unlocked and locked configurations. Furthermore, the joint wall 30 may include an aperture 44 extending therethrough, and coaxially aligned the slot 42 to allow the pin 36 to pass through the joint wall 30 and into the rolling ball 32.

The exercise device 10 is disposed in a locked configuration by aligning the aperture 38 formed within the rolling ball 32 with the aperture 44 formed within the joint wall 30, and then advancing the pin 36 through the apertures 38, 44 formed within the rolling ball 32 and joint wall 30, respectively. When the device 10 is in the locked configuration, the device 10 may be limited to translation along a single axis. For instance, the device 10 may be moved forward and backward, without side to side motion, or alternatively, the device 10 may be moved in a side to side motion without forward and backward motion. It is also contemplated that when the device 10 is in the locked configuration, movement of the ball may be restricted in all directions to allow the device to be used as a pivot board. Therefore, the locking mechanism 34 gives the user the option of selectively disposing the device in a locked configuration or the unlocked configuration, depending upon the range motion desired by the user.

Figure 6:
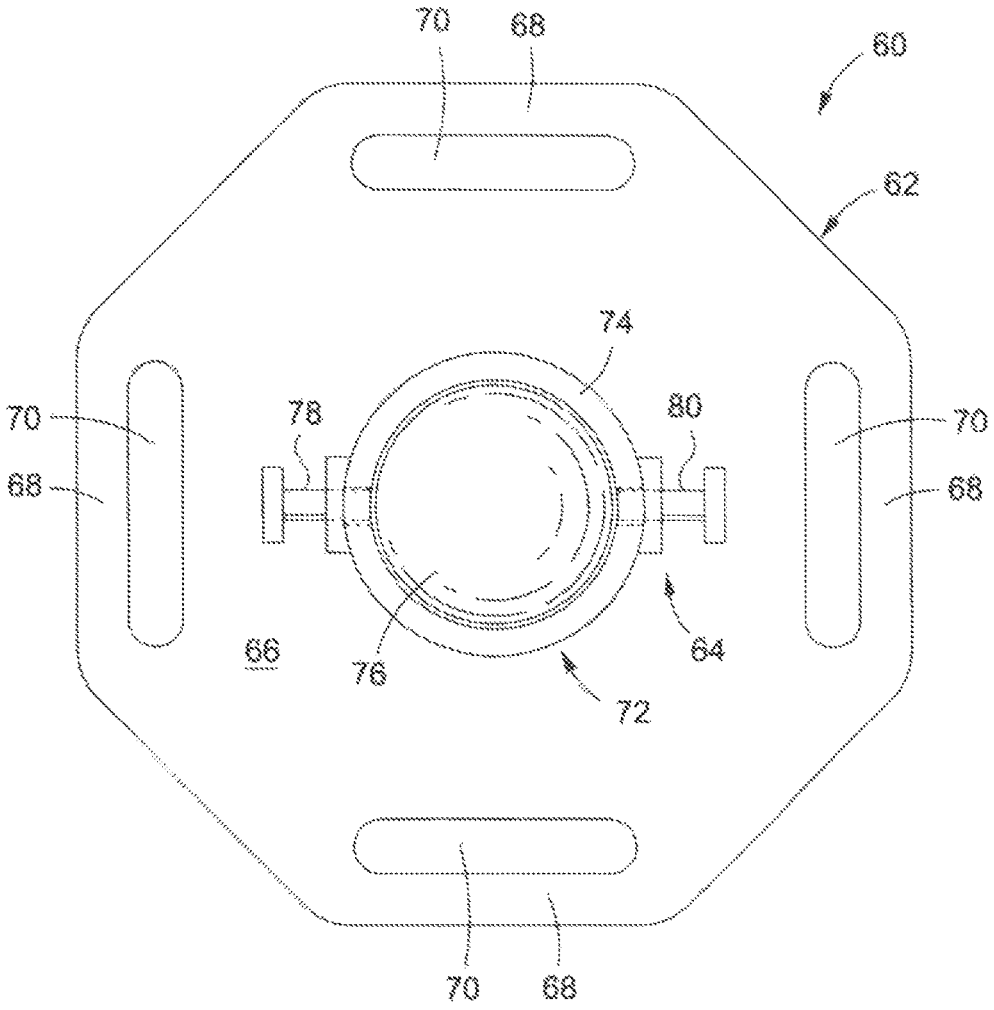
FIG. 6 is a bottom view of a second embodiment of the exercise device.
Figure 7:
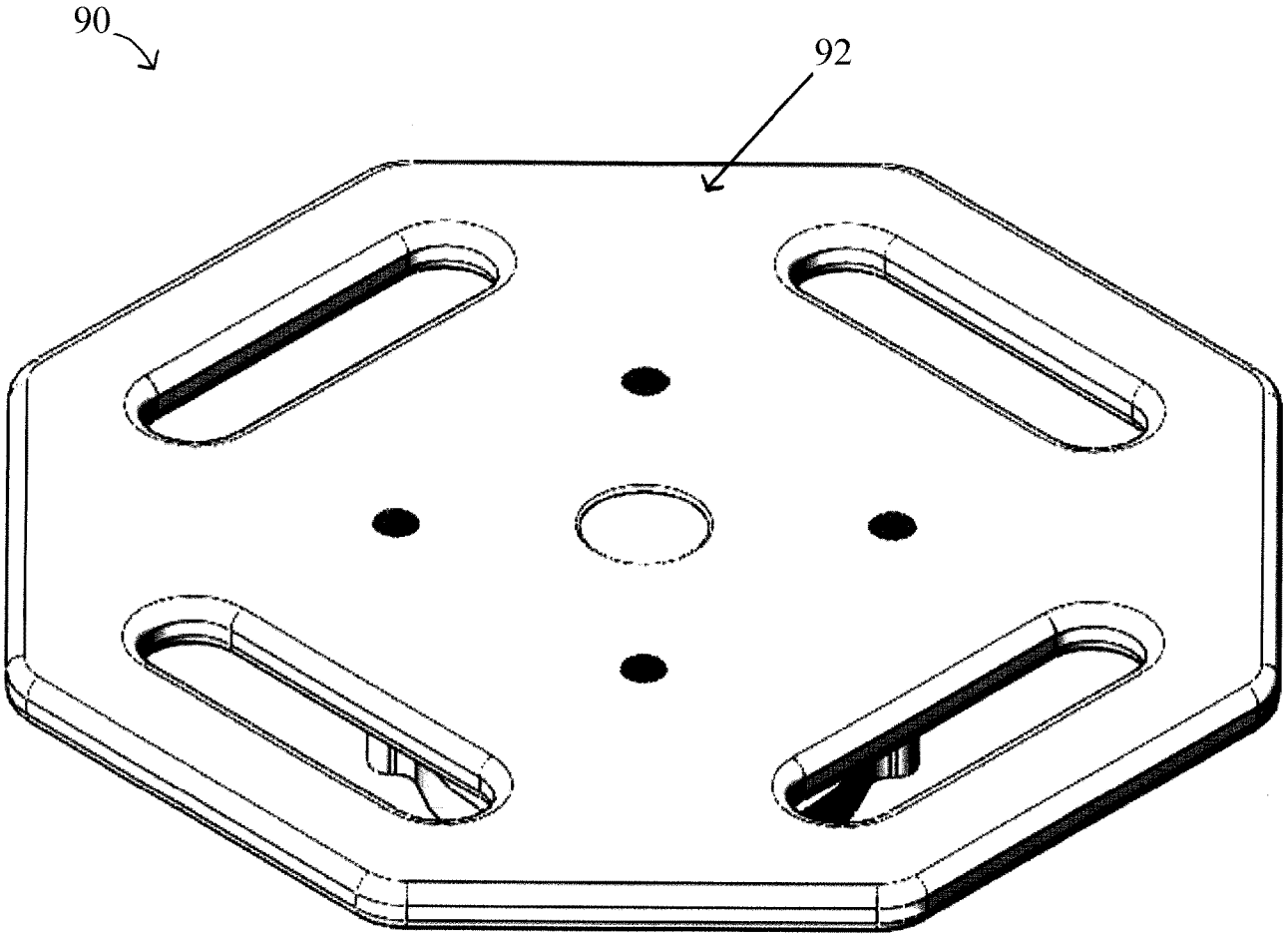
FIG. 7 is an upper perspective view of a third embodiment of an exercise device.
Figure 8:
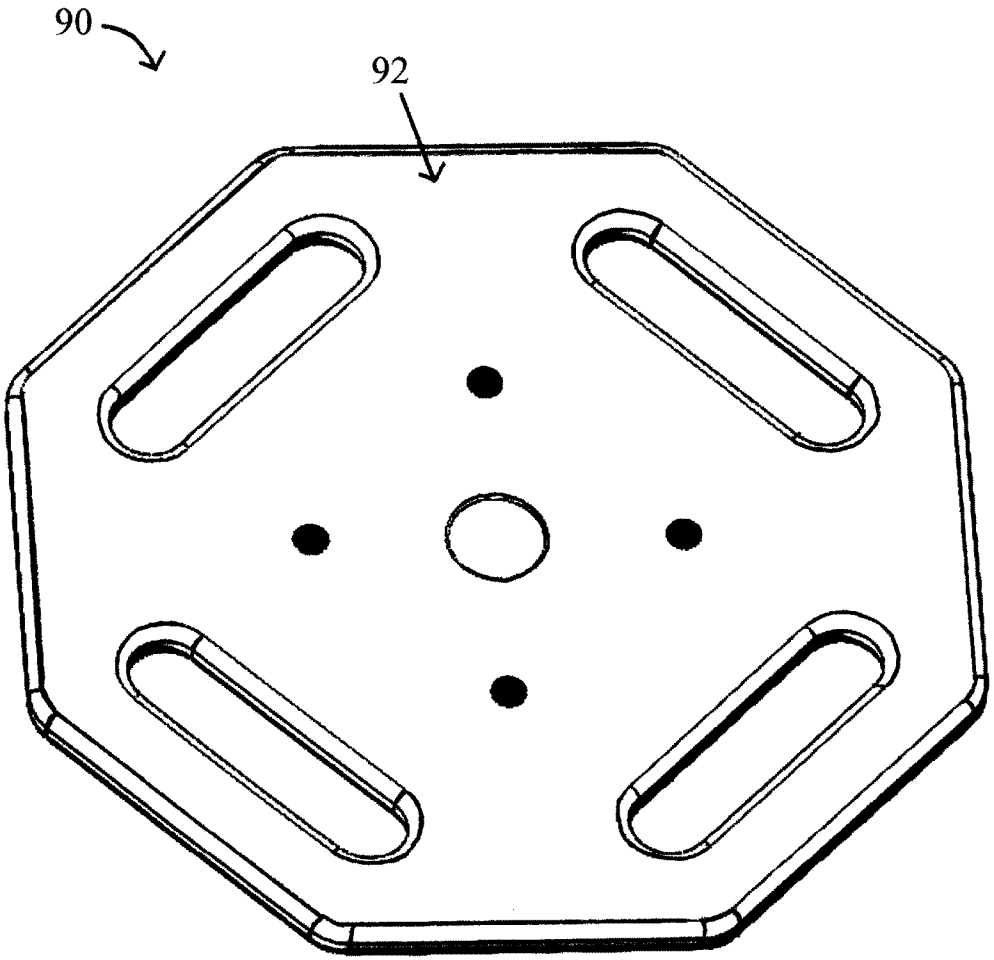
FIG. 8 is another upper perspective view of the third embodiment of the exercise device.

Referring now to FIG. 6, there is shown a bottom view of a second embodiment of the exercise device 60. As described in more detail below, the primary distinction between the exercise device 60 shown in FIG. 6, and the exercise device 10 shown in FIGS. 1-5 lays in the particular configuration of the support surface 62 and a locking mechanism 64.

The support surface 62 includes a first face and an opposing second face 66. The periphery of the support surface 62 is defined by eight substantially equal edges to define an octagonal shape. The support surface 62 additionally includes four handles 68, arranged in two opposed pairs. Each handle 68 is defined by an opening 70 extending through the support surface 62 from the first face to the second face 66. The additional handles 68 (relative to the device 10 depicted in FIGS. 1-5, and discussed above) allows the user to grip the device 60 at several locations thereof. Although the embodiment in FIG. 6 shows four handles 68, it is understood that fewer than four handles 68 or more than four handles 68 may be defined by the support surface 62 without departing from the spirit and scope of the present invention.

The exercise device 60 further includes a rolling joint 72 including a joint wall 74 and a rolling ball 76 similar to the rolling joint 14 discussed above. Therefore, the discussion of the rolling joint 14 discussed above in relation to the exercise device 10 equally applies to the rolling joint 72 shown in relation to exercise device 60.

A locking mechanism 64 includes a first pin 78 and second pin 80 disposed on diametrically opposed ends of the rolling ball 76. The first and second pins 78, 80 are moveable between an unlocked configuration and a locked configuration to restrict the range of motion of the rolling ball 76 relative to the joint wall 74. Along these lines, the pins 78, 80 may engage with a pair of diametrically opposed indents formed within the rolling ball 76 to restrict rotation of the rolling ball 76 about a single axis. In this regard, when the pins 78, 80 are disposed within the indents, the pins 78, 80 are in the locked configuration. The pins 78, 80 are moved out of the indents to the unlocked configuration to allow the rolling ball 76 to freely rotate within the joint wall 74. In another configuration, an aperture may be formed within the rolling ball 76 such that the pins 78, 80 may be advanced through the aperture to restrict rotation of the rolling ball 76 about a single axis. In such a configuration, the pins 78, 80 are in the locked configuration when the pins 78, 80 are advanced into the aperture formed within the rolling ball 76. The pins 78, 80 are in the unlocked configuration when they are removed from the aperture formed within the rolling ball 76 to thereby allow the rolling ball 76 to freely rotate within the joint wall 74.

Referring now to FIGS. 7-10, there is shown a third embodiment 90 of an exercise device. The device 90 includes a support surface 92 that is similar to the support surface 62 discussed above in relation to exercise device 60. Therefore, the discussion above in relation to support surface 62 applies to support surface 92 and will not repeated herein. The primary distinction lies in the rolling joint 94, and will be discussed in more detail below.

Figure 10:
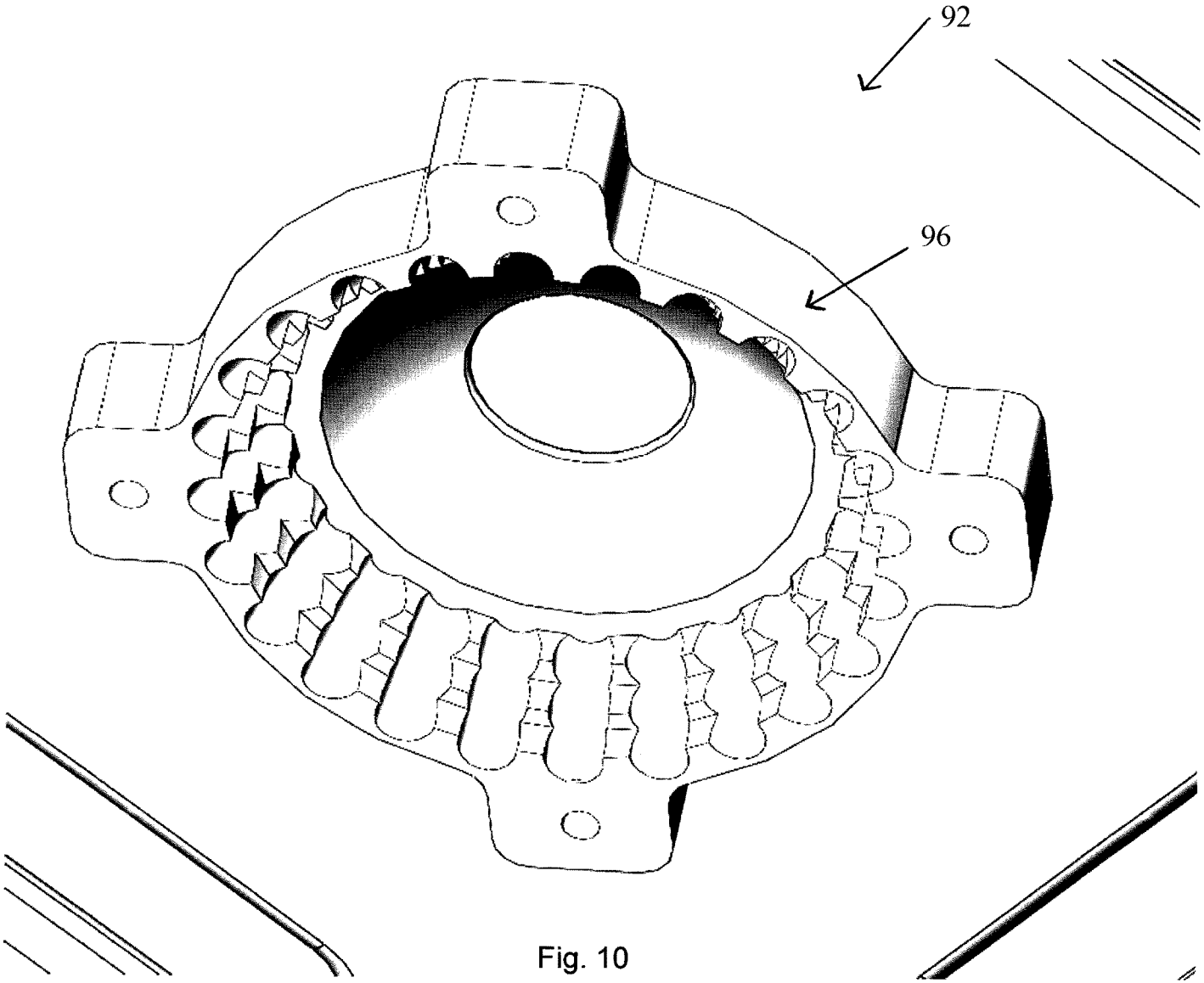
FIG. 10 is an enlarged lower perspective view of the exercise device shown in FIGS. 7-9, with the rolling ball removed from the rolling joint.

Referring specifically to FIG. 10, the rolling joint 94 includes a joint housing 96 extending from the support surface 92. The joint housing 96 includes an inner joint wall 98 that generally conforms to the configuration of the rolling ball 100. To minimize friction, portions of the inner wall 98 may be removed to create a plurality of contact points between the inner wall 98 and the rolling ball 100. By distributing the load over many small contact points, the rolling resistance between the joint housing 96 and the rolling ball 100 is reduced. Resistance may further be achieved by inserting a plurality of bearings within the cavities formed within the inner wall 98. The bearings may allow the rolling ball 100 to more freely rotate within the joint housing 96, while at the same time minimizing resistance.

Figure 9:
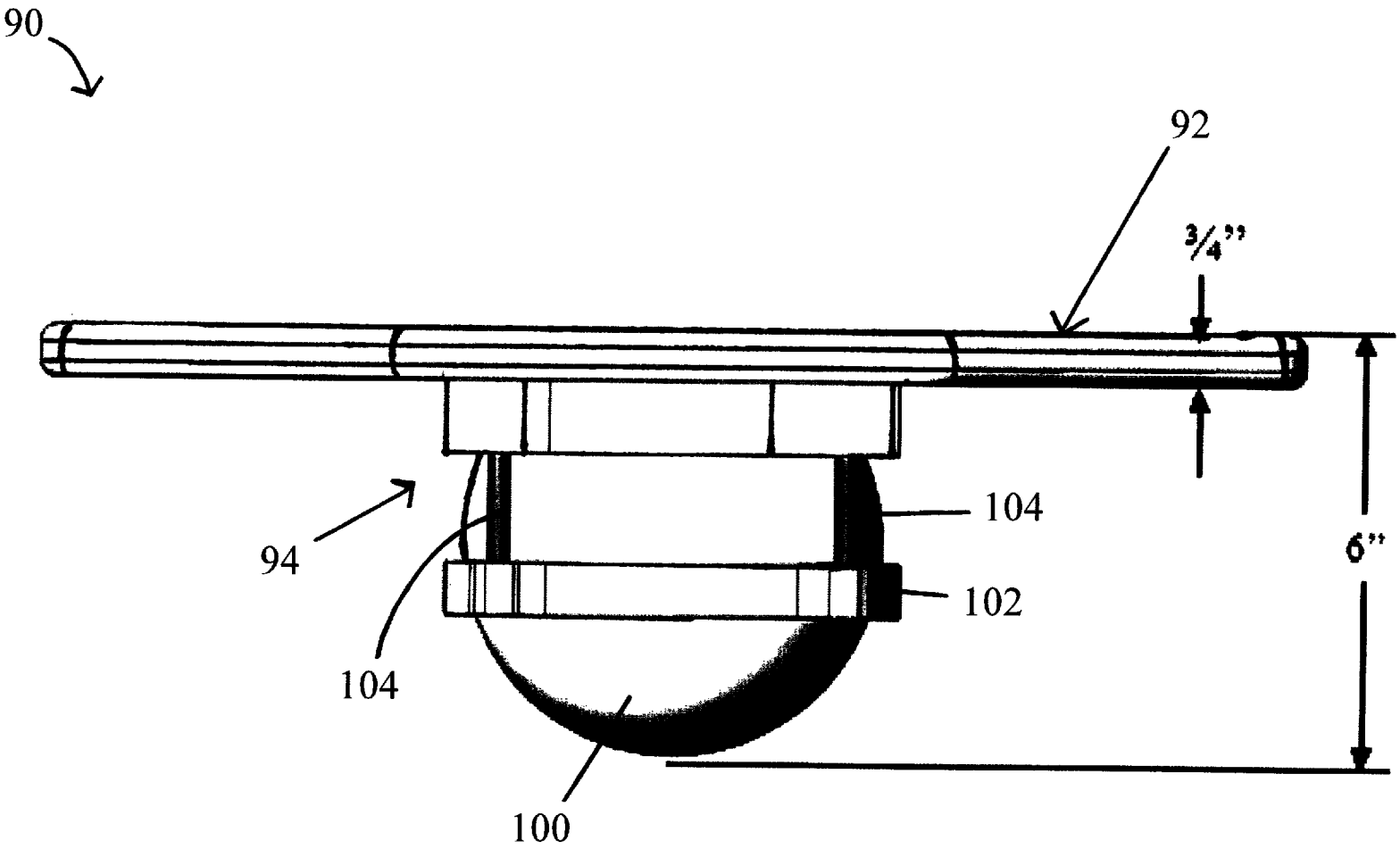
FIG. 9 is a side view of the exercise device shown in FIGS. 7 and 8.

Referring now specifically to FIG. 9, there is shown a bracket 102 that extends around the rolling ball 100 and is connected to the joint housing 96 by a plurality of rods 104. The bracket 102 is configured to maintain the rolling ball 100 within the joint housing 96, while at the same time allowing the rolling ball 100 to rotate therein.

According to one embodiment, the bracket 102 is configured to apply a braking force on the rolling ball 100 to restrict movement of the rolling ball 100. Along these lines, the bracket 102 may be selectively adjusted relative to the rolling ball 100 to increase or decrease the resistance of the exercise device 90. When the braking force is increased, the resistance increases, and when the braking force decreases, the resistance decreases. The braking force may be increased to a point which restricts movement of the rolling ball 100 to allow the device 90 to be used as a pivot board.

Figure 11:
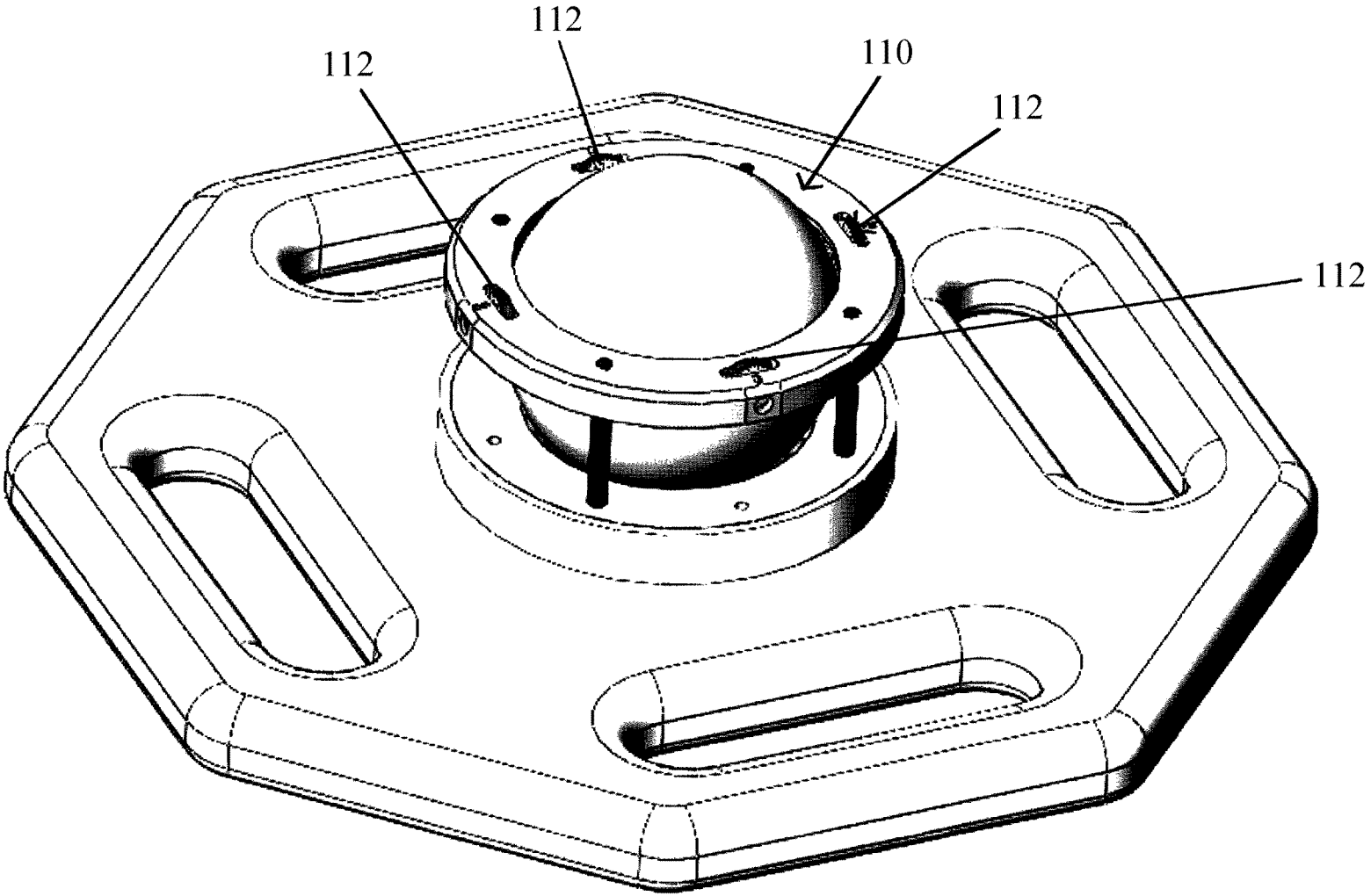
FIG. 11 is a lower perspective view of a fourth embodiment of an exercise device.
Figure 12:
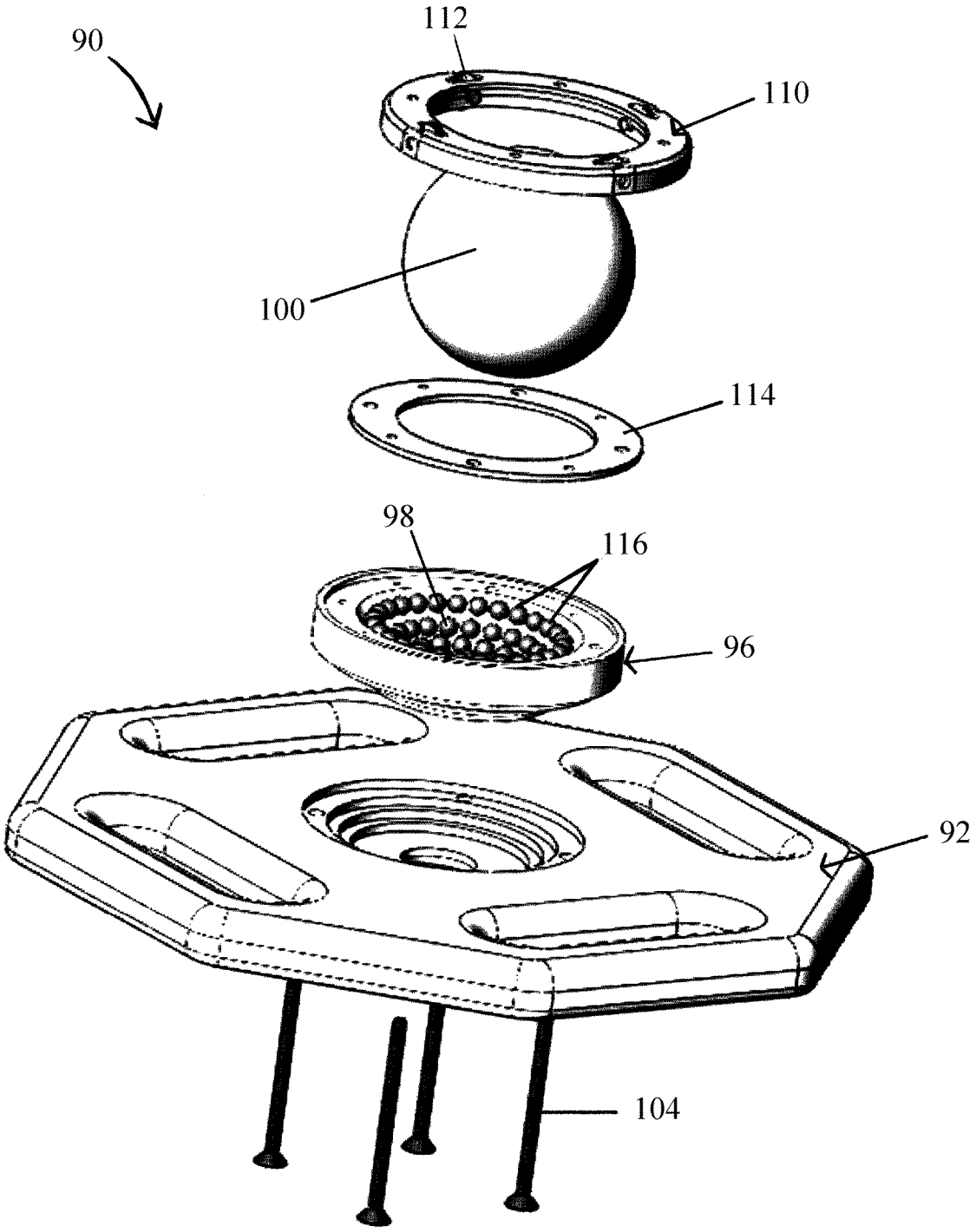
FIG. 12 is an exploded lower perspective view of the exercise device depicted in FIG. 11.

FIGS. 11-12 show a second embodiment of a bracket 110 having a plurality of auxiliary rolling discs 112, which may be used to enhance the movement of the exercise device 90 upon a surface. For instance, if the device 90 is supported by the rolling ball 100 on the support surface and the device 90 is tilted, the rolling discs 112, may facilitate rotation of the device 90 over the surface. The bracket 110 may also be configured to perform the same functions as the bracket 102 described above, including the functions of maintaining the ball 100 in place and applying a braking force on the ball 100.

In the exemplary embodiment, the bracket 110 includes four auxiliary rolling discs 112 arranged at 90 degree increments along the bracket 110 (i.e., equally spaced). In this regard, the four rolling discs 112 are arranged in two diametrically opposed pairs of discs 112, with each disc in a given disc pair is disposed in parallel relation to the other disc in the disc pair.

Although the exemplary embodiment includes four auxiliary rolling discs 112 equally spaced along the bracket 110, those skilled in the art will readily appreciate that fewer than four rolling discs 112 may be used or more than four rolling discs 112 may be used without departing from the spirit and scope of the present invention. Furthermore, the spacing of the discs 112 along the bracket 102 may also be varied.

FIG. 12 is an exploded view of the embodiment of the exercise device 90 depicted in FIG. 11. The exploded view illustrates the gripping member 92, the joint housing 96, a washer 114, the rolling ball 100, the bracket 110 and the rods 104. The exercise device 90 includes a plurality of bearings 116 disposed within cavities formed within the inner wall 98 such that the bearings 116 reduce the friction between the joint housing 96 and the rolling ball 100.

Figure 13:
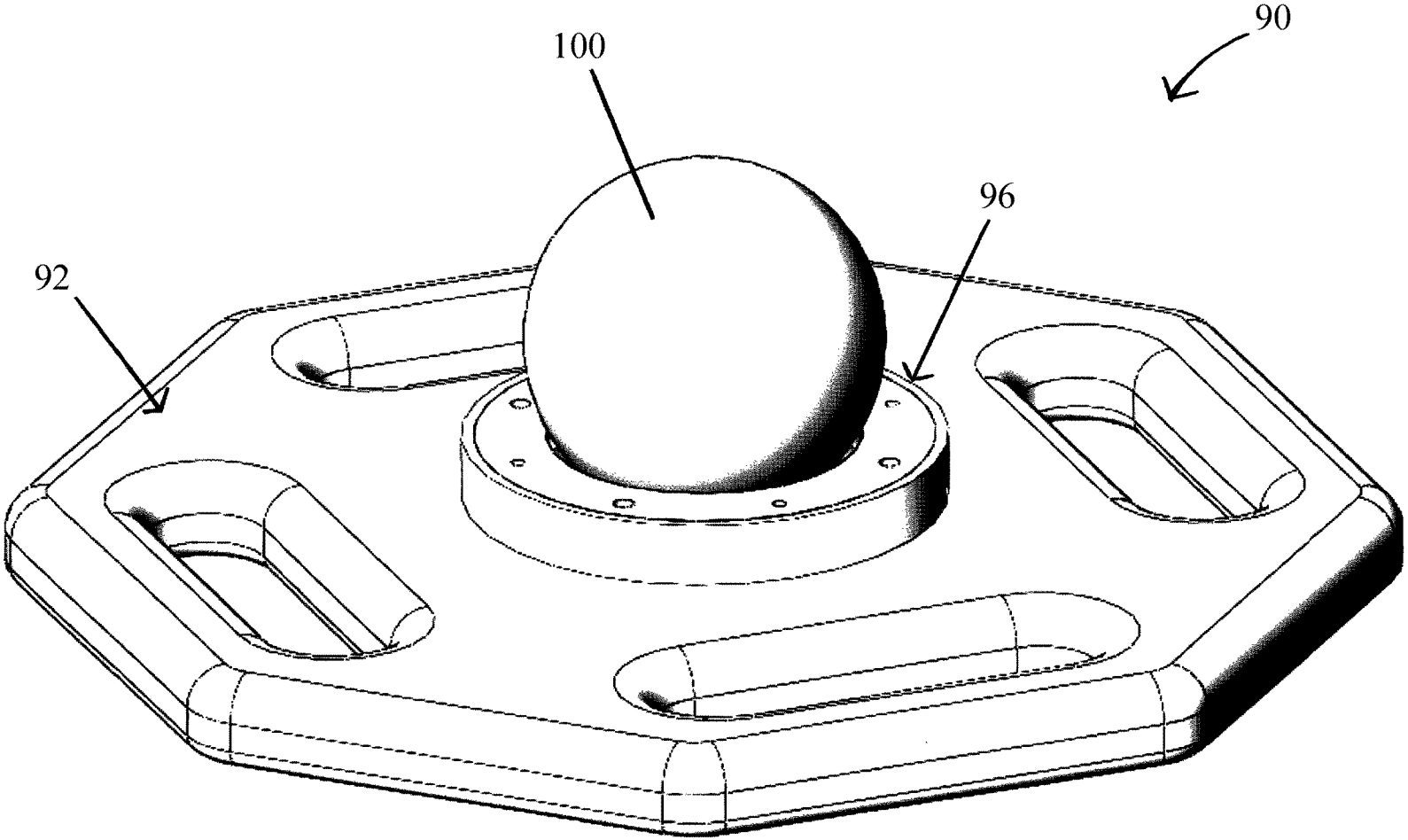
FIG. 13 is a partial lower perspective view of the exercise device shown in FIGS. 10-11.
Figure 14:
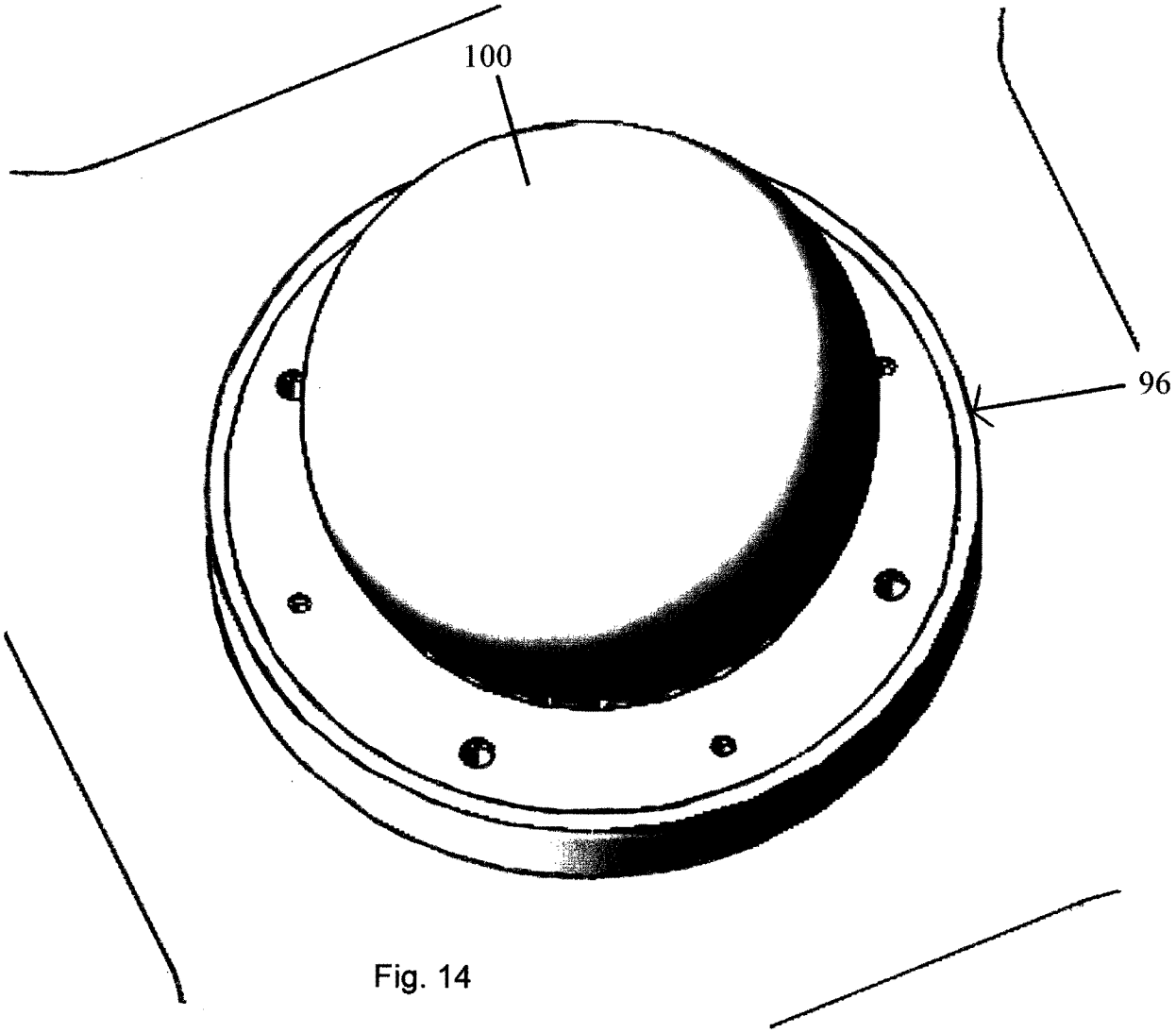
FIG. 14 is an enlarged, partial lower perspective view of the exercise device shown in FIG. 13.
Figure 15:
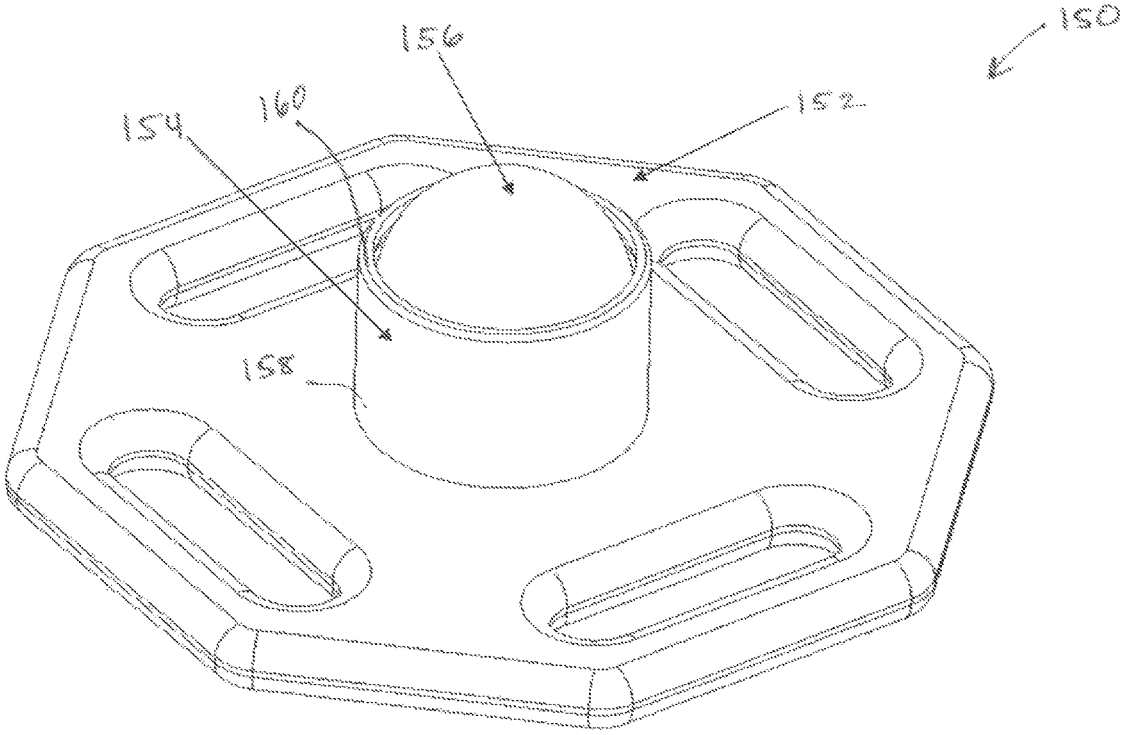
FIG. 15 is a lower perspective view of a fifth embodiment of an exercise device.
Figure 16:
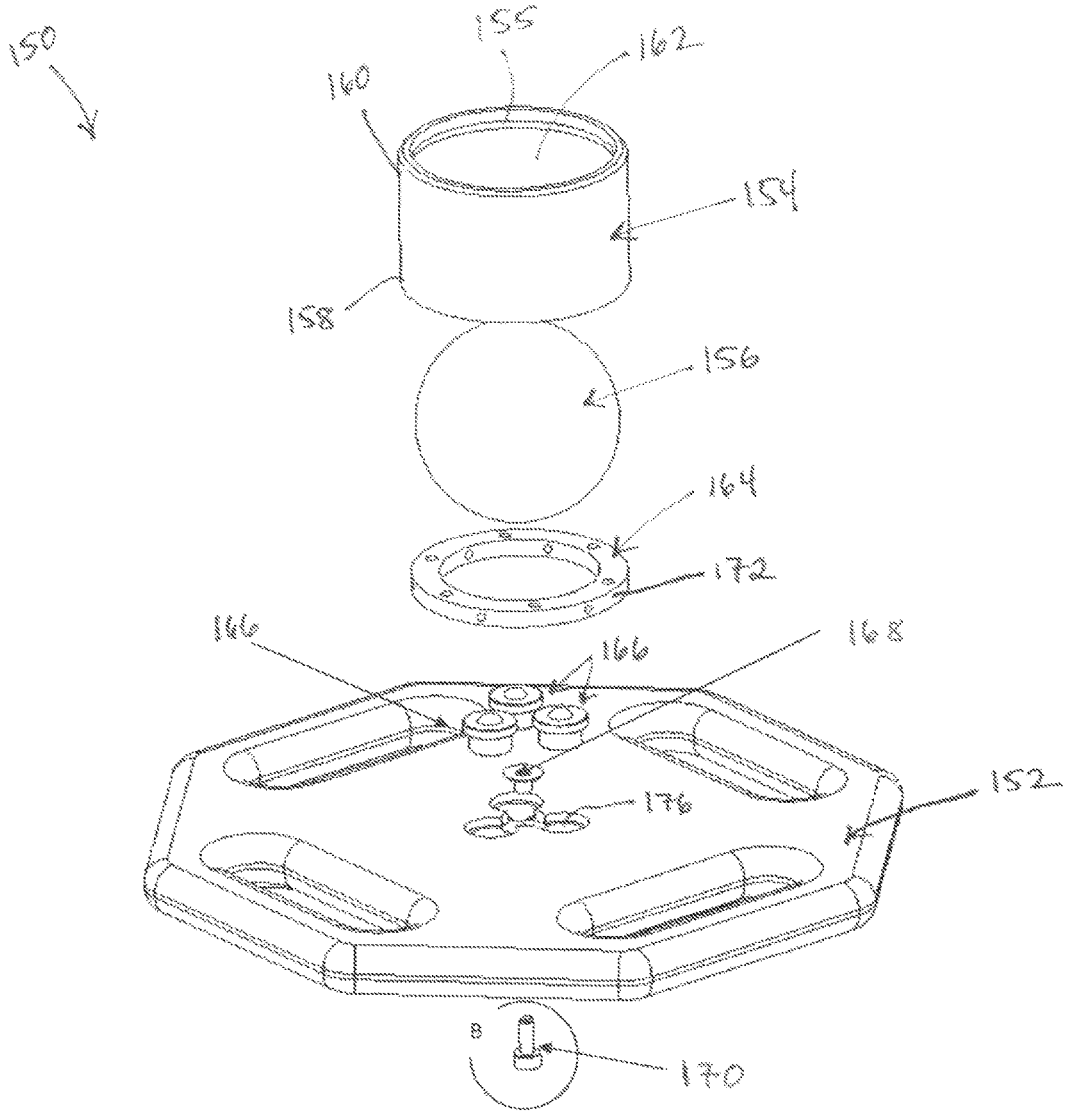
FIG. 16 is an exploded lower perspective view of the embodiment depicted in FIG. 15.
Figure 17:
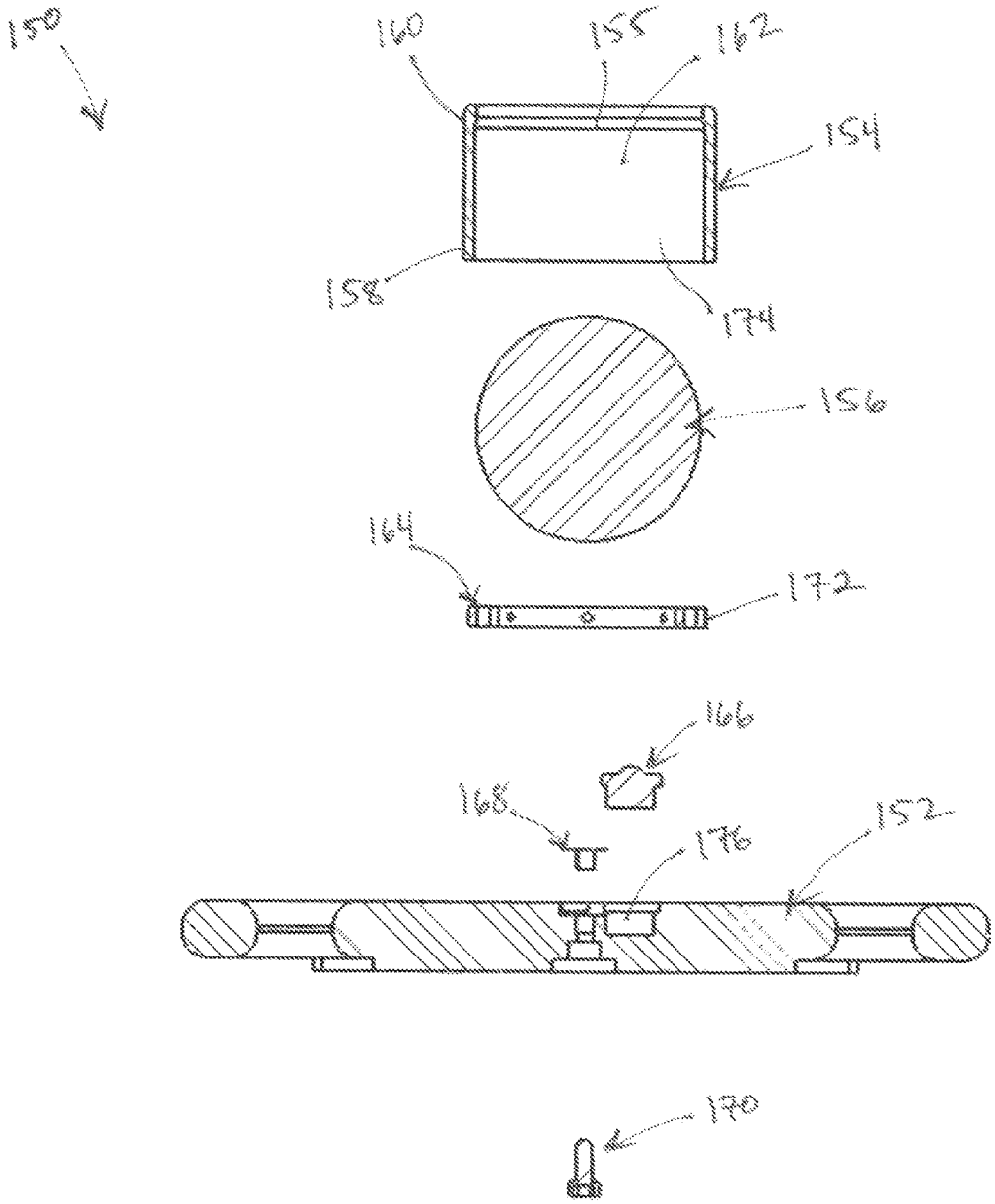
FIG. 17 is an exploded cross sectional view of the exercise device depicted in FIG. 16
Figure 18:
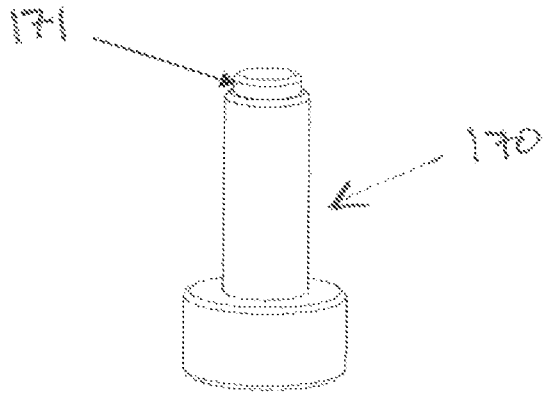
FIG. 18 is an upper perspective view of a pin used in the fifth embodiment of the exercise device.

FIGS. 13 and 14 are upper perspective views of the device 90, with the bracket 110 and rods 104 having been removed to more clearly show the rolling ball 100 seated within the joint housing 96.

Turning now to FIGS. 15-21, there is shown another embodiment of an exercise device 150. The exercise device 150 includes a gripping member 152, a retaining sleeve 154, and a roller ball 156. The gripping member 152 is similar to the gripping members 12, 62, 92 previously shown and discussed above. Therefore, the above description of the gripping members 12, 62, 92 applies equally to the gripping member 152.

The retaining sleeve 154 is connected to the gripping member 152 and is configured to retain the roller ball 156. In the exemplary embodiment, the retaining sleeve 154 is substantially cylindrical in shape and defines a first end portion 158 connected to the gripping member 152 and an opposing second end portion 160 extending away from the gripping member 152. The retaining sleeve 154 extends along a longitudinal axis and includes an annular wall disposed about the longitudinal axis to define a sleeve opening 162 (see FIG. 16) extending from the first end portion 158 to the second end portion 160. The roller ball 156 is received within the sleeve opening 162 and is configured to roll within the retaining sleeve 154 during usage of the exercise device 150. According to one embodiment, the retaining sleeve 154 includes a lip 155 (see FIG. 21) which retains the roller ball 156 within the sleeve opening 162. In this regard, the lip 155 extends into the sleeve opening 162 to define a diameter that is less than the diameter of the roller ball 156.

Figure 20:
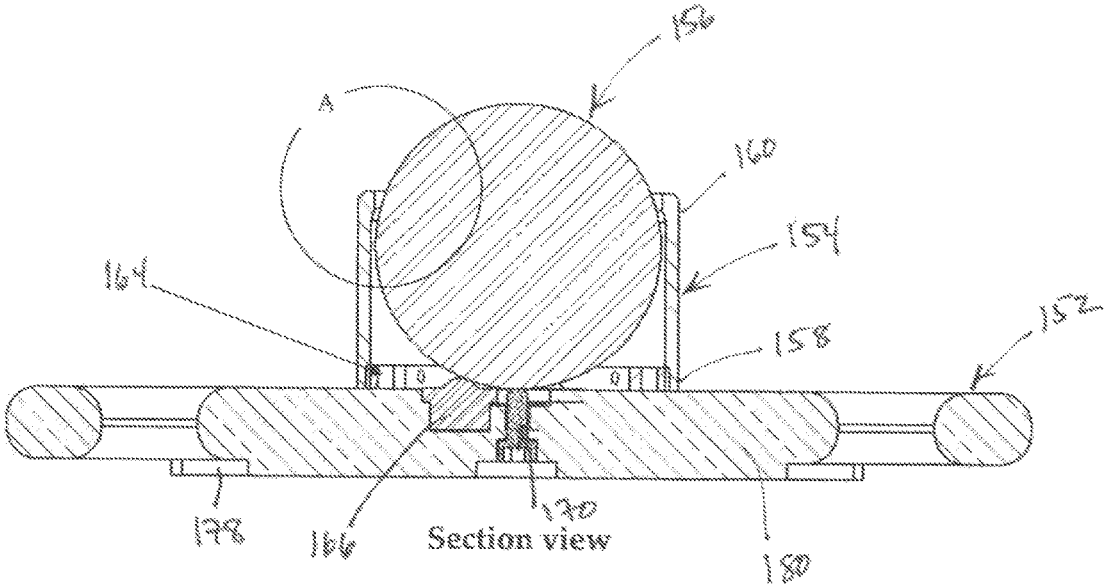
FIG. 20 is a side sectional view of the exercise device depicted in FIG. 15.
Figure 21:
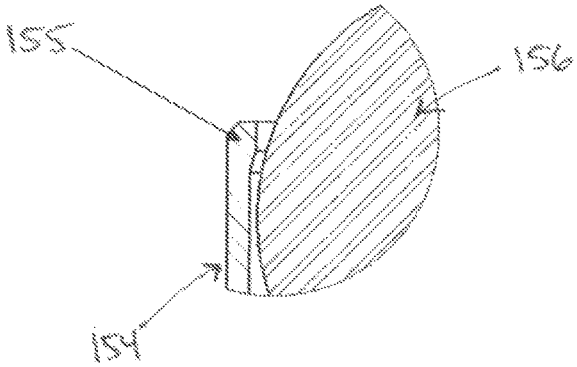
FIG. 21 is an enlarged, partial side sectional view of the exercise device depicted in FIG. 20.

The exercise device 150 additionally includes a support ring 164, a plurality of ball transfers 166, a "T" nut 168, and a locking screw 170, with the T nut 168 being engaged with the locking screw 170 (see FIG. 20). The locking screw 170 may include a plastic tip 171 (see FIG. 18) to protect the roller ball 156.

Referring now to FIG. 20, which shows a cross section of the exercise device 150, the support ring 164 resides within the sleeve opening 162 adjacent the gripping member 152 such that the outer wall 172 of the support ring 164 provides radial support to the inner wall 174 of the retaining sleeve 154.

The ball transfers 166 reside within respective recesses 176 formed within the gripping member 152. The ball transfers 166 provide a mechanism which allows the roller ball 156 to smoothly rotate within the sleeve opening 162. Those skilled in the art will appreciate that the ball transfers 166 are exemplary in nature only, and other bearings or rolling mechanisms known in the art may also be used.

Figure 19:
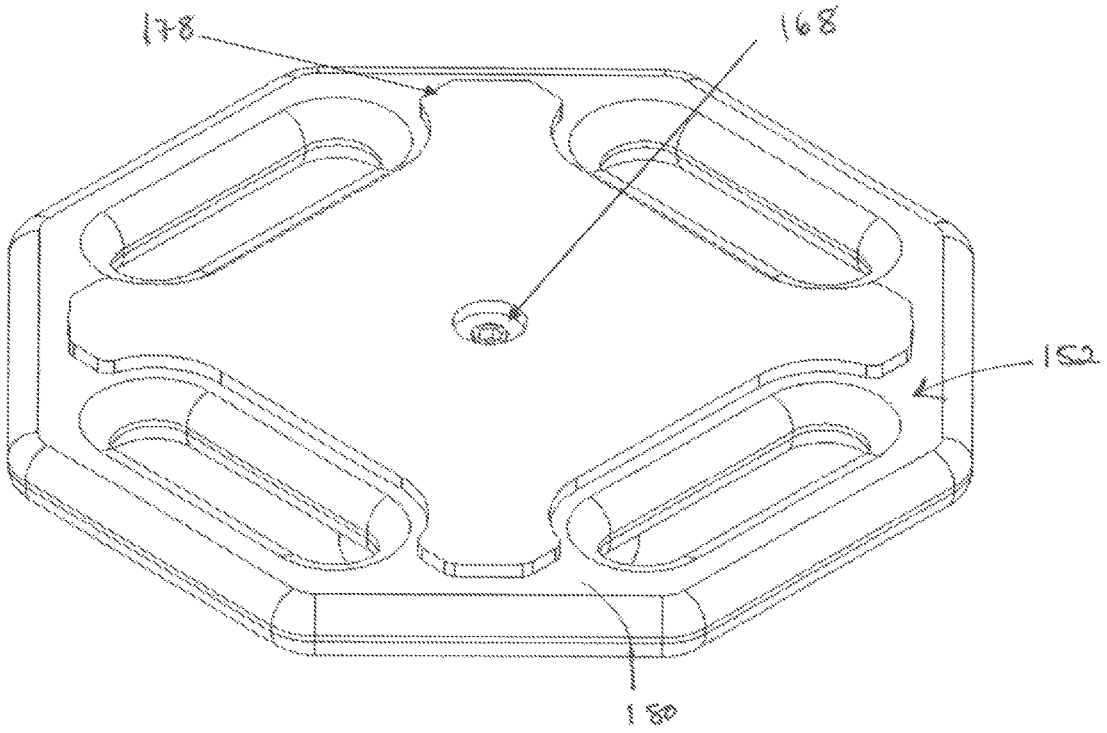
FIG. 19 is an upper perspective view of the exercise device depicted in FIG. 15.

Referring now specifically to FIG. 19, the gripping member 152 may include a pad member 178 connected to the gripping member body 180. The pad member 178 may be useful if the user kneels or stands on the gripping member 152 during exercise.

Figure 22:
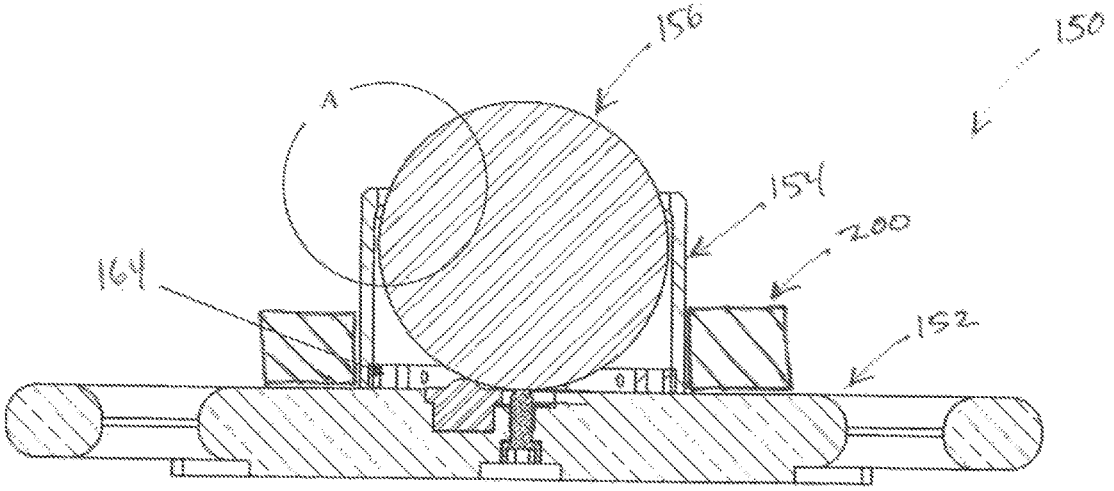
FIG. 22 is a side sectional view of a weighted ring connected to the exercise device.

Referring now to FIGS. 22-26, there is shown several accessories which may be used with the exercise device. FIG. 22 is a side sectional view showing a weighted ring 200 connectable to the exercise device 150. When a user performs an exercise and the weighted ring 200 is connected to the exercise device 150, the weight of the assembly (which includes the weight of the ring 200 and device 150) is collectively more than the weight of the exercise device 150 alone. Thus, the user may experience more resistance by connecting one or more weighted rings to the exercise device 150. The weighted ring 200 may define any weight which may be desirable to the user. For instance, the weighted right 200 may weigh 1-lb, 5-lbs, 10-lbs or any other weight known by those skilled in the art.

As shown, the weighted ring 200 circumnavigates the retaining sleeve 154 when the ring 200 is connected to the exercise device 150, so that the ring 200 is coaxially aligned with the sleeve 154. The inner surface of the ring 200 may be sized to frictionally engage with the outer surface of the ring 200 to connect the ring 200 to the exercise device 150. It is also contemplated that the ring 200 may engage with the gripping member 152, such as via magnetic connection, hook and loop fasteners or other mechanical fasteners known by those skilled in the art. When multiple rings 200 are used, the rings 200 may be arranged in a stacked arrangement.

Figure 23:
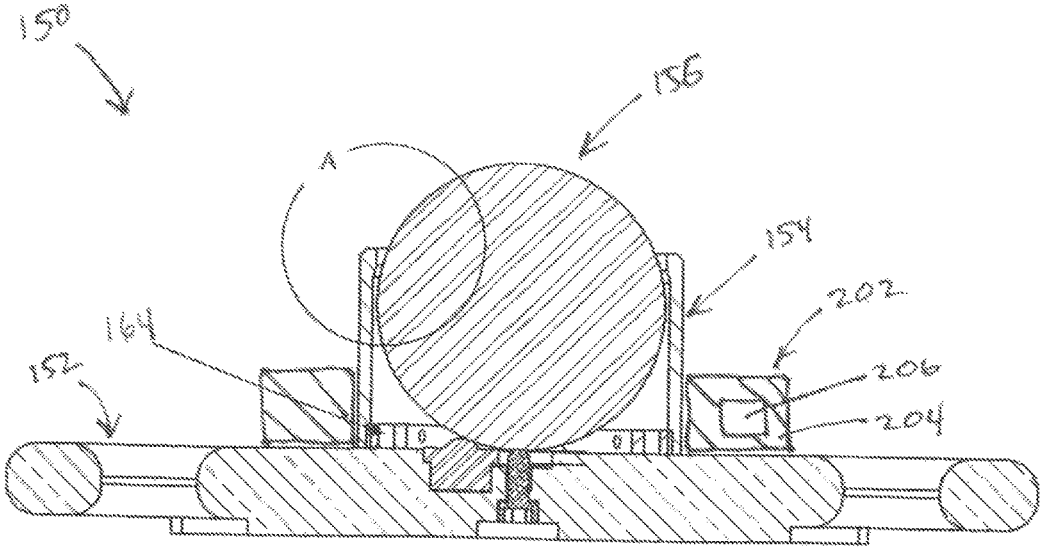
FIG. 23 is a side sectional view of a vibration element connected to the exercise device.

Referring now specifically to FIG. 23, there is shown another accessory which may be used with the exercise device 150, specifically, a vibration element 202. The vibration element 202 is shaped similar to the weighted ring 200 described above and may engage with the exercise device 150 in a similar fashion. The vibration element 202 includes a main body 204 and a vibrating mechanism 206 connected to the main body 204. The vibrating mechanism 206 may be comprised of any vibration inducing device known by those skilled in the art.

Figure 24:
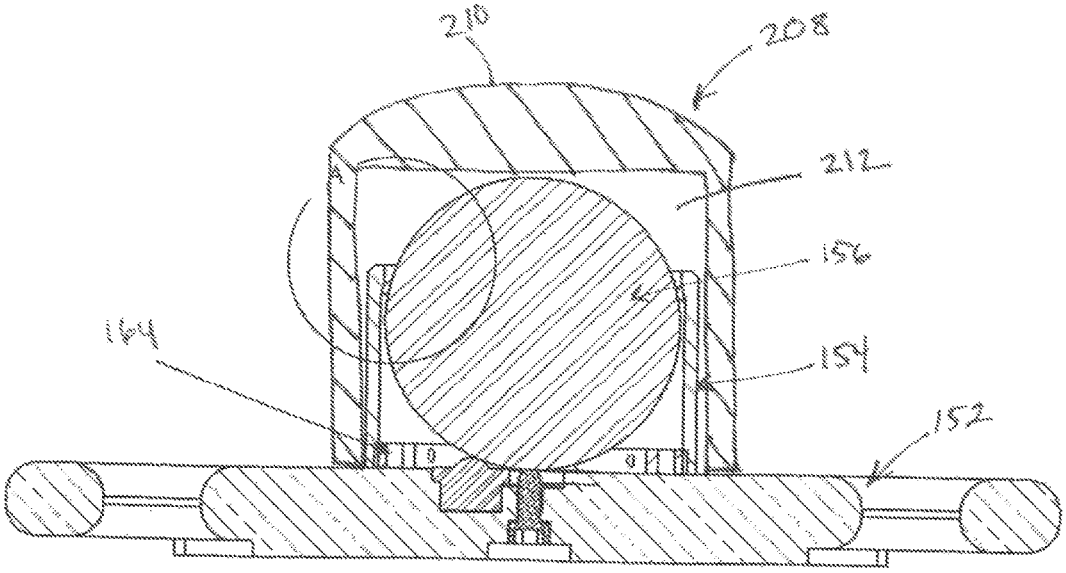
FIG. 24 is a side sectional view of an end cap disposed over the roller ball of the exercise device.

Referring now specifically to FIG. 24, there is shown an end cap 208 which fits over the roller ball 156 to cover the roller ball 156. Thus, instead of the exercise device 150 rolling along a support surface, the end cap 209 may engage the support surface to allow a user to practice balancing exercises on the exercise device 150. In this regard, the distal surface 210 of the end cap 208 may define an arcuate configuration to facilitate pivoting of the exercise device 150 on the support surface.

The end cap 208 may define an end cap cavity 212 sized to receive the roller ball 156 and the retaining sleeve 154. The end cap 208 may be connectable to the exercise device 150 such as by threadable engagement between the end cap 208 and the retaining sleeve 154 or gripping member 152, to fixedly secure the end cap 208 thereto. Alternatively, the end cap may be configured to simply slip over the roller ball 156 and the retaining sleeve 154 for ease of use.

The various embodiments of the exercise devices discussed above may be used to exercise several different muscle groups. For instance, the device may be used on a horizontal surface, such as the floor, to exercise the user's back and abs. The device may also be used along a vertical surface to exercise the user's leg (i.e., squats). The device may also be employed for rehabilitation to guide/support a user performing certain rehabilitation exercises, such as rehabbing a hip flexor (i.e., lateral leg extensions) or a shoulder (i.e., arm extensions). In this regard, the device is extremely adaptable to serve a wide range of needs and functions.

Figure 25:
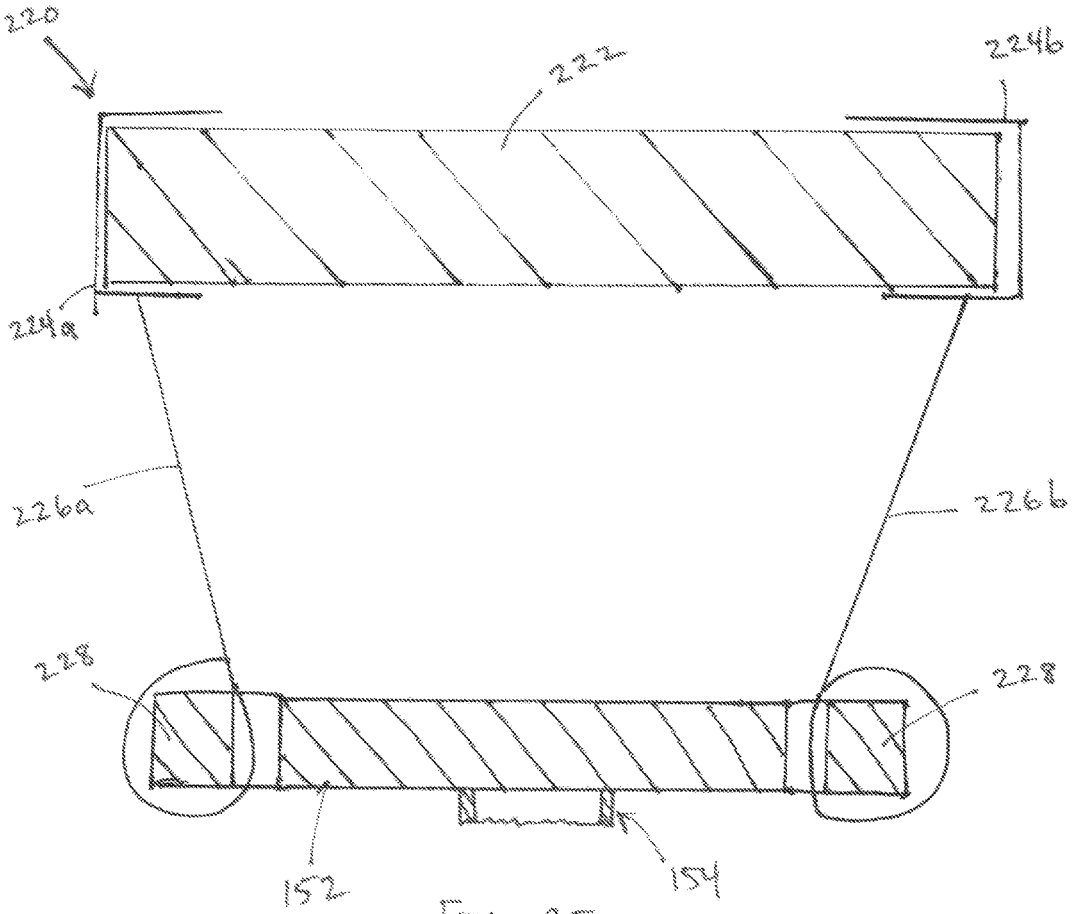
FIG. 25 is a top sectional view of a bracket mount for connecting the exercise device to a door.

In view of the various exercises that may be performed using the exercise device, there are several attachments which may be used with the exercise device to perform various exercises. Referring now specifically to FIG. 25, there is shown a door mounting system 220 for connecting the exercise device to a door 222. The door mounting system 220 includes a door attachment 224 including a first bracket 224*a* and a second bracket 224*b*. The brackets 224*a*, 224*b* are sized to easily connect and clamp on to a conventional door 222. Although the door attachment 224 shown in the drawings is a bracket-type mechanism, it is understood that other attachment mechanisms may also be used without departing from the spirit and scope of the present invention. For instance, the door attachment 224 may include a belt or strap, which is wrapped around the door 222 and is cinched tightly to secure the belt to the door 222.

The door mounting system 200 further includes a pair of straps 226*a*, 226*b* which are connected to respective ones of the first and second brackets 224*a*, 224*b*. The straps 226*a*, 226*b* include a distal end portion which may be wrapped around the handle 228 of the gripping member 152 to connect the straps 226*a*, 226*b* to the gripping member 152.

The straps 226*a*, 226*b* provide resistance as the user pulls the gripping member 152 away from the door 222. Therefore, the user may stand facing the door and pull the gripping member 152 toward the user's chest such that the resistance in the straps 226*a*, 226*b* provides an upper body workout for the user.

Figure 26:
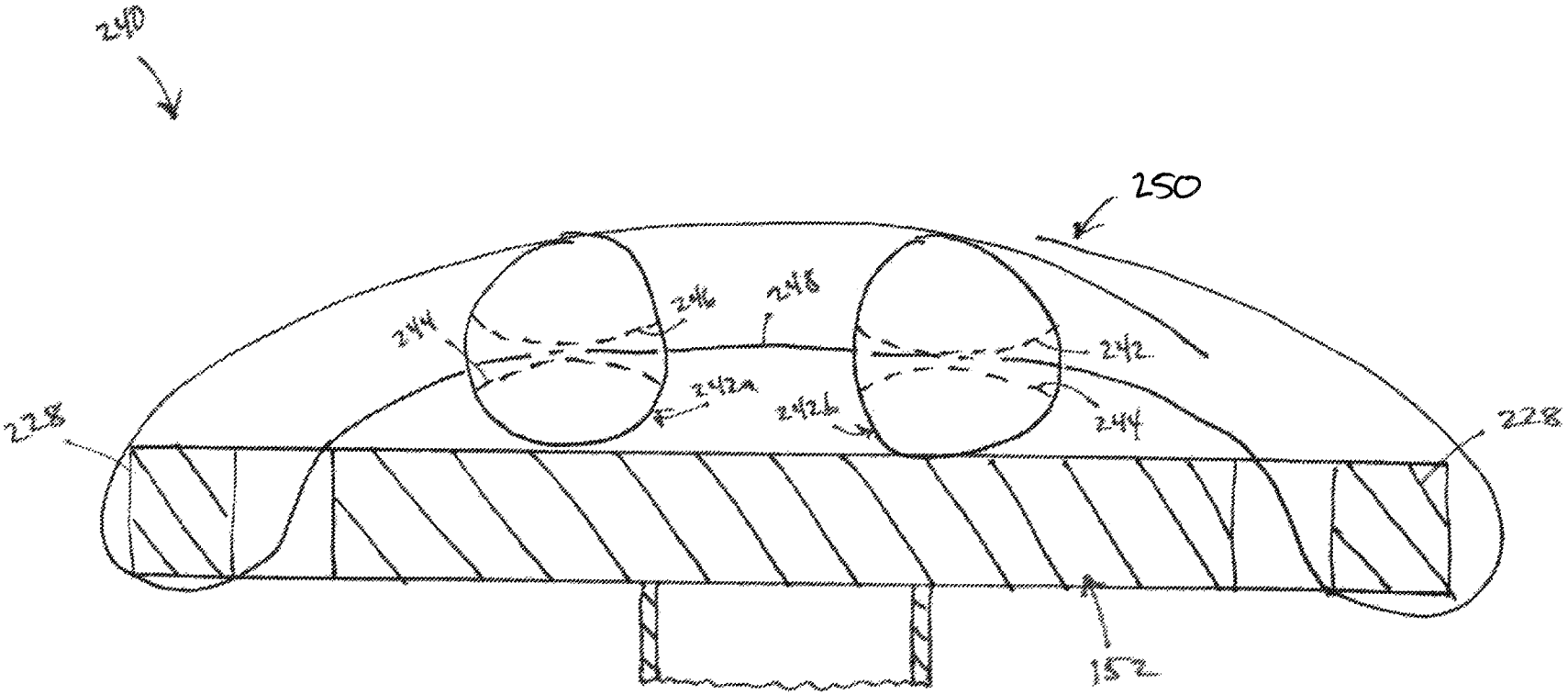
FIG. 26 is a side sectional view of a leg strap for connecting the exercise device to a user's legs.

Referring now to FIG. 26, there is shown another accessory which may be used with the exercise device. More specifically, the accessory shown in FIG. 26 is a strap 240 used to secure a user's legs to the gripping member 152 when the user kneels on the device. The leg strap 240 is configured to secure the user's legs to the gripping member 152 when the user is in the kneeling position.

In the embodiment shown in FIG. 26, the user's legs 242*a*, 242*b* are shown with the user's calves outlined by dotted lines 244 and the user's upper thigh outlined by dotted lines 246. The leg strap 240 includes a first segment 248 that extends between the user's calves and thighs when the user is kneeling on the gripping member 152. The leg strap 240 passes through the handles 228 and includes a second segment 250 that extends over the user's thighs. The leg strap 240 attaches to itself to secure the leg strap 240 to the user. The leg strap 240 may be cinched onto the user's legs to tighten the leg strap 240 onto the user. The leg strap 240 may include hook and loop fasteners, buttons, snaps or other mechanical fasteners to fasten the leg strap 240 onto itself.

Kneeling on the exercise device 150 allows the user to perform several different exercises for stretching, toning, strengthening different parts of the user's body.

Although the foregoing describes and shows the various attachments/accessories, i.e., the weighted ring 200, the vibration element 202, the end cap 208, the door mounting system 220, and the leg straps 240, in connection with exercise device 150, it is contemplated that the attachments/accessories may also be readily adapted for use with other embodiments of the exercise device, including those shown and described herein.

Figure 27:
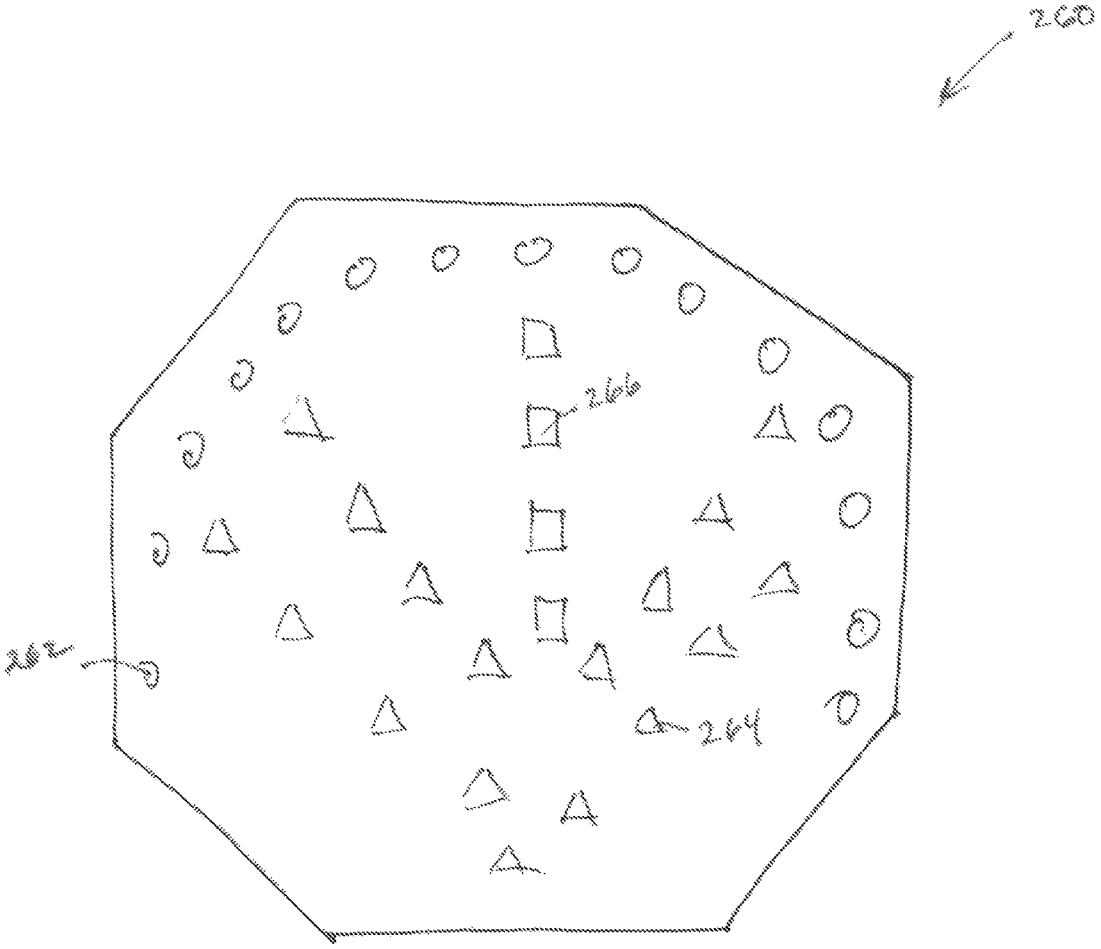
FIG. 27 is a top view of a floor mat configured for use with the exercise device.

In addition to the foregoing, and referring now specifically to FIG. 27, there is also provided an exercise mat 260 configured for use with the exercise devices 10, 60, 90, 150. The mat 260 may be placed on a support surface and used to perform various exercises with the exercise devices 10, 60, 90, 150. Along these lines, the mat includes various symbols, references, markers, etc, to guide the user through various exercises. For instance, in the mat 260 shown in FIG. 27, the circular symbols 262 provide an arcuate path along which the user may follow when performing an exercise, i.e., rolling the exercise device 10, 60, 90, 150, along the mat 260. The triangular symbols 264 provide a series of linear paths angled outwardly from a centerline, which is marked by a series of axially aligned quadrangular symbols 266.

Additional modifications and improvements of the present invention may also be apparent to those of ordinary skill in the art. Thus, the particular combination of components and steps described and illustrated herein is intended to represent only certain embodiments of the present invention, and is not intended to serve as limitations of alternative devices and methods within the spirit and scope of the invention.

What is claimed is:

1. An exercise device comprising:

a support plate having an upper surface defining an upper plane and a lower surface defining a lower plane;

a pair of handles, each handle having at least a portion positioned between the upper plane and the lower plane;

a roller member rotatable relative to the support plate and rollable on a first surface, the roller member defining an upper portion and a lower portion, the lower portion being positioned between the upper portion and the first surface when the roller member rolls on the first surface; and a plurality of bearings interfacing with the upper portion of the roller member.

2. The exercise device recited in claim 1, wherein the roller member is rotatable relative to the plurality of bearings.

3. The exercise device recited in claim 1, wherein the plurality of bearing are moveable relative to the support plate.

4. The exercise device recited in claim 1, wherein the support plate includes an outer periphery spaced outwardly from the roller member.

5. The exercise device recited in claim 1, wherein the roller member defines a circumference, and the support plate circumnavigates at least a majority of the circumference of the roller member.

6. The exercise device recited in claim 1, wherein the plurality of bearings are spaced from the support plate.

7. The exercise device recited in claim 1, further comprising a retaining element coupled to the support plate and having a cavity sized and structured to at least partially receive the roller member, the plurality of bearings being located between the retaining element and the roller member.

8. The exercise device recited in claim 1, wherein the plurality of bearings are ball bearings.

9. An exercise device comprising:

a support plate having an upper surface defining an upper plane and a lower surface defining a lower plane;

a pair of handles positioned, at least in part, between the upper plane and the lower plane, the pair of handles and the support plate collectively defining a pair of openings therebetween;

a roller member coupled to the support plate and rotatable relative to the support plate;

a retaining element coupled to the support plate and having an arcuate surface extending over at least a portion of the roller member; and a plurality of bearings interfacing with the roller member, the plurality of bearings being located between the arcuate surface and the roller member.

10. The exercise device recited in claim 9, wherein the roller member is rollable along a rolling plane and the roller member having a top as that portion of the roller spaced farthest from the rolling plane, the roller member defining an midline between the top and the rolling plane, the plurality of bearing being located between the top and the midline.

11. The exercise device recited in claim 10, wherein at least two of the plurality of bearings are spaced from the top and the midline.

12. The exercise device recited in claim 9, wherein the roller member is rotatable relative to the plurality of bearings.

13. The exercise device recited in claim 9, wherein the plurality of bearing are moveable relative to the support plate.

14. The exercise device recited in claim 9, wherein the support plate includes an outer periphery spaced outwardly from the roller member.

15. The exercise device recited in claim 9, wherein the roller member defines a circumference, and the support plate circumnavigates at least a majority of the circumferences of the roller member.

16. The exercise device recited in claim 9, wherein the plurality of bearings are spaced from the support plate.

17. The exercise device recited in claim 9, wherein the plurality of bearings are ball bearings.

18. The exercise device recited in claim 1, wherein the upper surface and the lower surface are both planar and positioned in parallel relation to each other.

19. The exercise device recited in claim 1, wherein the pair of handles are integrally formed with the support plate.

20. The exercise device recited in claim 1, further comprising a pair of openings positioned between the support plate and respective ones of the pair of handles.

* * * * *